US006124067A

United States Patent [19]

Mikuriya et al.

[11] Patent Number: 6,124,067

[45] Date of Patent: Sep. 26, 2000

[54] MAGNETIC CARRIER, TWO-COMPONENT DEVELOPER AND IMAGE FORMING METHOD

[75] Inventors: Yushi Mikuriya, Numazu; Kenji Okado, Yokohama; Kazumi Yoshizaki, Mishima, all of Japan

[73] Assignee: Canon Kabushiki Kaisha, Tokyo, Japan

[21] Appl. No.: 09/358,409

[22] Filed: Jul. 22, 1999

[30] Foreign Application Priority Data

Jul. 22, 1998 [JP] Japan ..... 10-206036

[51] Int. Cl.[7] ..... G03G 9/113

[52] U.S. Cl. ..... 430/106.6; 430/108; 430/124

[58] Field of Search ..... 430/108, 106.6, 430/124

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,912,004 | 3/1990 | Nagatsuka et al. | 430/106.6 |
| 5,288,578 | 2/1994 | Sugizaki et al. | 430/108 |
| 5,641,600 | 6/1997 | Kotaki et al. | 430/106.6 |
| 6,010,811 | 2/1994 | Baba et al. | 430/108 |

FOREIGN PATENT DOCUMENTS

| | | |
|---|---|---|
| 0708379 | 4/1996 | European Pat. Off. . |
| 0801334 | 10/1997 | European Pat. Off. . |
| 0801335 | 10/1997 | European Pat. Off. . |
| 54-066134 | 5/1979 | Japan . |
| 58-021750 | 2/1983 | Japan . |
| 61-009659 | 1/1986 | Japan . |
| 4-198946 | 7/1992 | Japan . |
| 5-072815 | 3/1993 | Japan . |
| 7-319218 | 12/1995 | Japan . |

*Primary Examiner*—Christopher D. RoDee

*Attorney, Agent, or Firm*—Fitzpatrick, Cella, Harper & Scinto

[57] ABSTRACT

A magnetic carrier constituting a two-component developer for use in an electrophotographic image forming method is formed of a carrier core comprising a first resin and magnetic fine particles dispersed in the first resin, and a second resin surface-coating the carrier core. (a) The magnetic carrier has a true specific gravity of 2.5–4.5, a magnetization $\sigma_{1000}$ as measured in a magnetic field of $1000\times(10^3/4\pi)\cdot A/m$ (1000 oersted) of 15–60 $Am^2/kg$ (emu/g), a residual magnetization $\sigma_r$ of 0.1–20 $Am^2/kg$ (emu/g) and a resistivity of $5\times10^{11}$–$5\times10^{15}$ ohm.cm. (b) The first resin has a polymer chain including a methylene unit (—$CH_2$—). (c) The second resin has at least a fluoro-alkyl unit, a methylene unit (—$CH_2$—) and an ester unit. (d) The carrier core is surface-coated with (i) a mixture of the second resin and a coupling agent having at least an amino group and a methylene unit, or (ii) a coupling agent having at least an amino group and a methylene unit, and then with the second resin.

68 Claims, 6 Drawing Sheets

MAGNETIC CARRIER, TWO-COMPONENT DEVELOPER AND IMAGE FORMING METHOD

FIELD OF THE INVENTION AND RELATED ART

The present invention relates to a magnetic carrier for use in development of electrostatic images in electrophotography, electrostatic recording, etc., and a two-component developer and an image forming method using the magnetic carrier.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner is attached onto the latent image to develop the electrostatic image. Subsequently, the resultant toner image is transferred onto a transfer(-receiving) material such as paper, via or without via an intermediate transfer member, and then fixed , e.g., by heating, pressing, or heating and pressing, or with solvent vapor, to obtain a copy or a print.

In the step of developing an electrostatic image, an electrostatic interaction between a triboelectrically charged toner and the electrostatic image is utilized to form a toner image. Among various methods of developing electrostatic images with a toner, one of using a two-component developer obtained by mixing the toner with a carrier is suitably adopted in a full-color copying machine or printer expected to provide high-quality images.

In the developing method, the carrier functions to triboelectrically provide an appropriate level of positive or negative charge to the toner and carry the toner on its surface owing to an electrostatic attraction force caused by the triboelectric charge.

The developer comprising the toner and the carrier is applied onto a developing sleeve containing therein a magnet in a layer of a prescribed thickness controlled by a developer layer thickness-regulating member, and conveyed under the action of a magnetic force to a developing region formed between the developing sleeve and an electrostatic image-bearing member (photosensitive member).

Between the photosensitive member and the developing sleeve in the developing region, a prescribed developing bias voltage is applied, whereby the toner is transferred for development onto the photosensitive member.

The carrier is required of various properties, inclusive of, as particularly important ones, charge-imparting ability, durability against an applied voltage, impact resistance, wear resistance, less-soilability with toner, and developing performance.

For example, in case where a developer is used for a long period, the carrier surface is soiled with so-called "spent toner" which is a portion of toner melt-sticking and filming onto the carrier surface and is useless for development, whereby the developer is deteriorated and the developed images are accompanied with image quality deterioration.

Generally, if the carrier has an excessively large true specific gravity, the developer suffers from a large load when the developer is formed in a layer of a prescribed thickness on the developing sleeve or when the developer is stirred in the developing device. As a result, during the use of the developer for a long period, the developer is liable to be deteriorated by (a) toner filming, (b) carrier breakage and (c) toner deterioration, thus resulting in developed images with inferior image quality.

Further, if the carrier particle size is excessively large, the developer receives a large load similarly as above, thus being liable to suffer from the above-mentioned difficulties (a)–(c) and deteriorate the developer. Further, the developed images are liable to cause (d) a lowering in thin-line reproducibility.

Accordingly, a carrier liable to cause the difficulties (a)–(c) requires a periodical exchange of the developer which is uneconomical. Accordingly, it is desired to reduce the load applied to the developer or improve the impact resistance or anti-toner-soilability (or anti-spent toner characteristic) of the carrier, thus obviating the difficulties (a)–(c) to prolong the developer life.

If the carrier particle size is reduced, (e) the carrier is liable to attach to the electrostatic image-bearing member. Further, only the carrier particle size is reduced while the toner particle size remains at constant, the toner is provided with a broad distribution of charge and is particularly excessively charged ("charge-up") in a low humidity environment, thus being liable to cause a phenomenon of toner scattering onto the non-image portion ("fog").

As a type of carrier for solving the above-mentioned difficulties (a)–(f), a magnetic fine particle-dispersed resin carrier has been proposed. This carrier can be relatively easily formed in spheres which are accompanied with little strain morphologically, exhibit high mechanical strength and are excellent in flowability. The particle size thereof also can be controlled in a wide range, so that it is suitably used in a high-speed copying machine, a high-speed laser beam printer, etc., wherein the developing sleeve or the magnet in the sleeve is rotated at a high speed.

Such magnetic fine particle-dispersed resin carriers have been proposed in Japanese Laid-Open Patent Application (JP-A) 54-66134 and JP-A 61-9659. However, this type of carrier has a difficulty that it has a small saturation magnetization relative to its particle size unless it contains a large proportion of magnetic material, thus being liable to cause carrier attachment onto the electrostatic image-bearing member, so that it is necessary to install a mechanism for developer replenishment or attached carrier recovery within the image forming apparatus.

On the other hand, a magnetic fine particle dispersion-type resin carrier containing a large proportion of magnetic material is liable to have a weaker impact resistance because of an increased amount of the magnetic material relative to the binder resin, so that (g) the magnetic material is liable to fall off (or be liberated from) the carrier when the developer is formed in a layer of a prescribed thickness, thus resulting in deterioration of the developer.

Further, a magnetic fine particle-dispersion-type resin carrier containing a large proportion of magnetic material is liable to have a lower resistivity because of an increased amount of magnetic material having a low resistivity, so that (h) the bias voltage applied for development is liable to be leaked to result in inferior images.

JP-A 58-21750 has proposed a technique of coating a carrier core with a resin. The resin-coated carrier thus obtained may be provided with improved anti-toner soilability, impact resistance and withstandability against the applied voltage. Further, the toner charging performance can be controlled by selecting the charging characteristic of the coating resin.

However, the resin-coated carrier is also accompanied with a difficulty that a carrier having a high resistivity due to a large amount of coating resin is liable to cause a toner charge-up in a low humidity environment. Further, if the resin coating amount is less, the resultant carrier is caused to have a lower resistivity, thus being liable to cause inferior images due to leakage of the developing bias voltage.

Further, in case where a certain coating resin is used, even if a carrier coated with the resin exhibits a numerically appropriate resistivity, the carrier can cause inferior images due to leakage of the developing bias voltage, or another carrier can cause toner charge-up in a low humidity environment.

A type of carrier using a silane coupling agent inside and a fluorine-containing resin as an outer layer resin has been proposed as having improved anti-surface soilability, impact resistance, stable charging performance with less environmental dependence, and charge-exchangeability, in JP-A 4-198946, JP-A 5-72815, and JP-A 7-319218. However, the carriers of JP-A 4-198946 and JP-A 5-72815 cannot have a high coating rate because of a restriction in production process, thus leaving problems regarding little environmental dependence and sufficient toner-charging ability. The carrier of JP-A 7-319218 is a carrier of a medium resistivity exhibiting a volume resistivity of $1.5\times10^{9}$–$3.0\times10^{10}$ ohm.cm under application of a voltage of $10^{3.5}$ V/cm and is liable to cause a charge-injection from the developer-carrying member to the electrostatic image-bearing member in the developing region especially when a low-magnetization carrier or a low-resistivity electrostatic image-bearing member is used, thus being liable to cause carrier attachment onto the electrostatic image-bearing member or disorder of electrostatic images leading to image defects. Further, in the developer proposed, the spent toner attachment is liable to occur on the carrier in case of copying of a toner-consuming large area image on a large number of sheets, thus being liable to cause toner charge fluctuation.

In this way, there is still desired a magnetic carrier capable of complying with strict demands for quality, such as adaptability to various types of images including thin lines, small characters, photographic images and color originals, higher image quality, higher image forming speed, higher durability and continuous image forming performances.

SUMMARY OF THE INVENTION

A generic object of the present invention is to provide a magnetic carrier having solved the above-mentioned problems and a two-component developer using the magnetic carrier.

A more specific object of the present invention is to provide a magnetic carrier free of carrier attachment onto the electrostatic image-bearing member, and capable of providing high-quality toner images free from or with suppressed fog, and a two-component developer using the magnetic carrier.

Another object of the present invention is to provide a magnetic carrier capable of providing high-image density and high resolution color toner images without being affected by changes in temperature and humidity conditions, and a two-component developer using the magnetic carrier.

Another object of the present invention is to provide a magnetic carrier having excellent durability free from image deterioration even in image formation on a large number of sheets, and a two-component developer using the magnetic carrier.

A further object of the present invention is to provide an image forming method using such a two-component developer.

According to the present invention, there is provided a magnetic carrier, comprising: a carrier core comprising a first resin and magnetic fine particles dispersed in the first resin, and a second resin surface-coating the carrier core; wherein (a) the magnetic carrier has a true specific gravity of 2.5–4.5, a magnetization $\sigma_{1000}$ as measured in a magnetic field of $1000\times(10^{3}/4\pi)\cdot$A/m (1000 oersted) of 15–60 $Am^2$/kg (emu/g), a residual magnetization $\sigma_r$ of 0.1–20 $Am^2$/kg (emu/g) and a resistivity of $5\times10^{11}$–$5\times10^{15}$ ohm.cm;

(b) the first resin has a polymer chain including a methylene unit (—$CH_2$—);

(c) the second resin has at least a fluoroalkyl unit, a methylene unit (—$CH_2$—) and an ester unit; and (d) the carrier core is surface-coated with (i) a mixture of the second resin and a coupling agent having at least an amino group and a methylene unit, or (ii) a coupling agent having at least an amino group and a methylene unit, and then with the second resin.

According to the present invention, there is also provided a two-component developer, comprising: a negatively chargeable toner, and the above-mentioned magnetic carrier, wherein the toner comprises toner particles and an external additive.

According to the present invention, there is further provided an image forming method, comprising: charging an electrostatic image-bearing member, exposing the charged electrostatic image-bearing member to light image to form an electrostatic image on the electrostatic image-bearing member, developing the electrostatic image by a developing means including the above-mentioned two-component developer to form a toner image on the electrostatic image-bearing member, transferring the toner image on the electrostatic image-bearing member via or without via an intermediate transfer member onto a transfer material, and fixing the toner image on the transfer material under application of heat and pressure to form a fixed toner image on the transfer material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
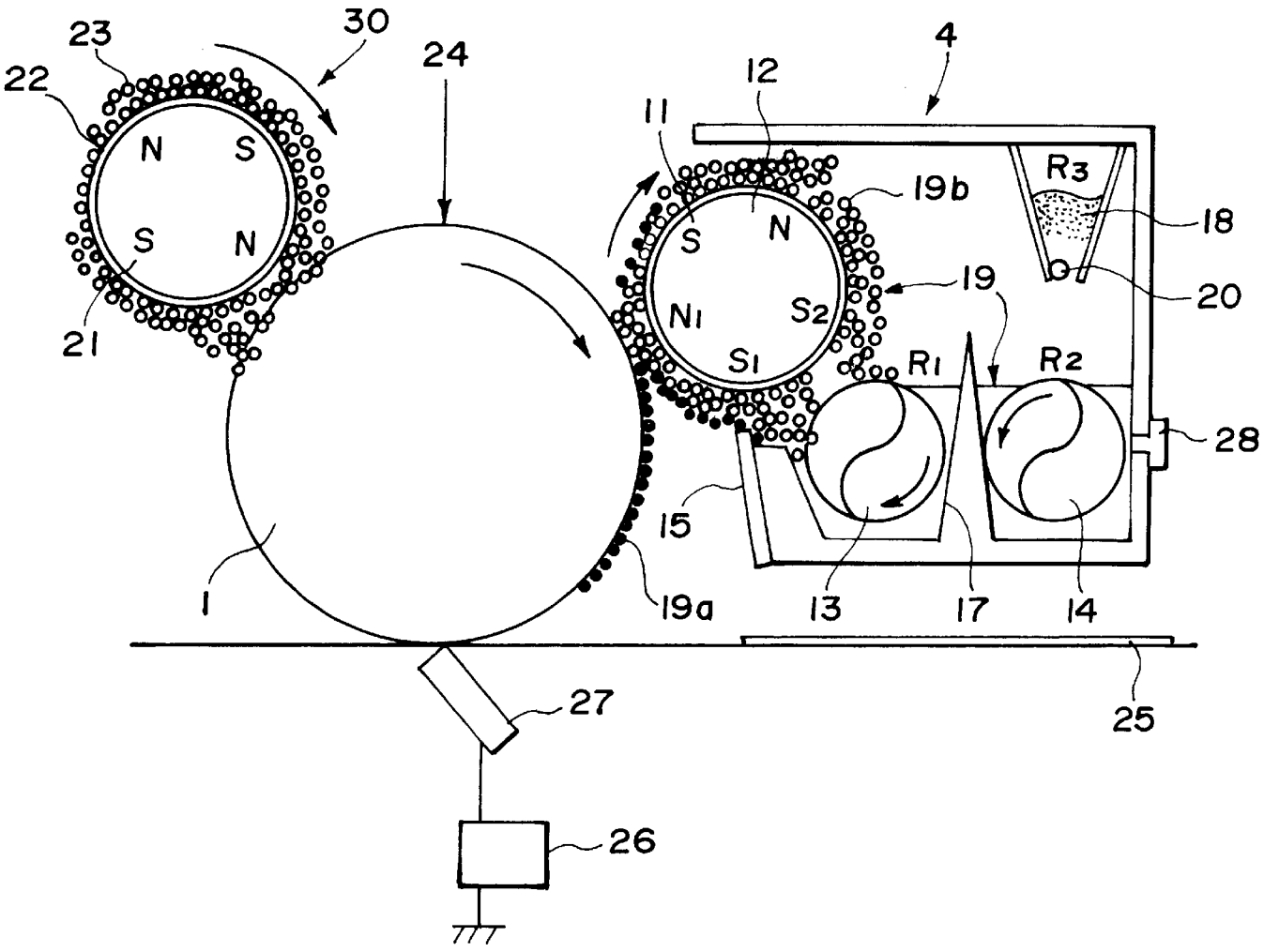
FIG. 1 is a schematic illustration of an image forming system suitable for practicing an embodiment of the image forming method according to the invention.

As a result of our study for providing improvements to the above-mentioned problems, it has been found effective to use a magnetic carrier obtained by coating a carrier core of a magnetic fine powder-dispersed resin with a fluorine-containing coating resin simultaneously with or immediately after treatment with a specific coupling agent so as to provide a resistivity of $5\times10^{11}$–$5\times10^{15}$ ohm.cm.

The magnetic carrier of the present invention comprising magnetic fine particles dispersed in a resin has a true specific gravity of 2.5–4.5, preferably 3.0–4.3. If the true specific gravity is in this range, the toner receives only a small load during blending under stirring of the magnetic carrier and the toner, the soiling of the carrier surface with the toner is suppressed, and the carrier attachment onto a non-image part on the electrostatic image-bearing member is also suppressed.

The magnetic carrier of the present invention has a magnetization $\sigma_{1000}$ as measured at a magnetic field of $1000\times(10^3/4\pi)\cdot A/m$ (=1000 oersted) of 15–60 $Am^2.kg$ (emu/g), preferably 20–55 $Am^2/kg$, and a residual magnetization $\sigma_r$ of 0.1–20 $Am^2/kg$ (emu/g), preferably 0.3–10 $Am^2.kg$. If the magnetic carrier has magnetic properties in these ranges, the attachment of the magnetic carrier onto the electrostatic image-bearing member is suppressed and the compression force applied onto the toner in the magnetic brush of two-component developer is alleviated to suppress the soling of the carrier with the toner particles and the external additive, under the action of a magnetic field exerted by a magnetic field-generating means, such as a fixed magnet, disposed within a developer-carrying member (developing sleeve). If the residual magnetization $\sigma_r$ of the magnetic carrier exceeds 20 $Am^2.kg$, the exchange between the two-component developer on the developer-carrying member and the two-component developer in the developer container is not uniformly performed, so that the toner charge-up or toner charge fluctuation is liable to occur.

The magnetic carrier of the present invention has a resistivity in the range of $5\times10^{11}$–$5\times10^{15}$ ohm.cm, so that the magnetic carrier is less liable to cause carrier attachment onto the electrostatic image-bearing member and better suppresses the toner charge-up.

If the magnetic carrier has a resistivity below $5\times10^{11}$ ohm.cm, a charge injection from the developer-carrying member to the electrostatic image-bearing member is liable to occur in the developing region, thus being liable to cause carrier attachment onto the electrostatic image-bearing member, disorder of electrostatic images and image defects. On the other hand, if the magnetic carrier has a resistivity exceeding $5\times10^{15}$ ohm.cm, the charge generated by triboelectrification with the toner cannot be leaked therefrom and the toner charge is liable to be excessively increased, thus being liable to cause a image density lowering and fog due to the toner charge-up, particularly in low humidity environment. Further, a problem of image density lowering in a middle part of a solid image than at the peripheral edge, is liable to occur.

The magnetic carrier of the present invention is also characterized in that (i) the first resin constituting the carrier core has a polymer chain including a methylene unit (—$CH_2$—);

(ii) the second resin surface-coating the carrier core has at least a fluoro-alkyl unit, a methylene unit (—$CH_2$—) and an ester unit; and (iii) the carrier core is surface-coated with (i) a mixture of the second resin and a coupling agent having at least an amino group and a methylene unit, or (ii) a coupling agent having at least an amino group and a methylene unit, and then with the second resin.

By surface-coating a carrier core composed of a first resin and magnetic fine particles with a second resin having at least the above-mentioned three types of units, it becomes possible to provide a magnetic carrier capable of suppressing the soiling with the toner and the external additive while retaining an ability of providing a negative triboelectric charge to a negatively chargeable toner. If the surface coating of the carrier core with the second resin is effected, either by first treading the carrier core surface with a coupling agent having at least an amino group and a methylene unit and then coating the treated carrier core with the second resin, or by surface-coating the carrier core with a mixture of the second resin and the coupling agent, an improved adhesion is given between the carrier core and the second resin, and the resultant carrier is provided with an enhanced negative triboelectric charge-imparting ability.

Examples of the first resin constituting the carrier core may include: vinyl resins, polyester resins, epoxy resins, phenolic resins, urea resins, polyurethane resins, polyimide resins, cellulose resins and polyether resins, each having a methylene unit (—$CH_2$—) in its polymer chain. These resins may be used singly or in mixture of two or more species.

Examples of vinyl monomer for providing the vinyl resin may include: styrene; styrene derivatives, such as o-methylstyrene, m-methylstyrene, p-methylstyrene, p-phenylstyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; ethylenically unsaturated monoolefins, such as ethylene, propylene, butylene and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate methacrylic acid; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acid; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; and acrolein. These may be used singly or in mixture of two or more species to form a vinyl resin.

The magnetic carrier core particles comprising magnetic fine particles dispersed in the first resin may for example be prepared by subjecting a mixture of a monomer and magnetic fine particles to polymerization to directly provide carrier core particles. Examples of the monomer used for the polymerization may include the above-mentioned vinyl monomers, a combination of a bisphenol or a derivative thereof and epichlorohydrin for producing epoxy resins; a combination of a phenol and an aldehyde for producing phenolic resins; a combination of urea and an aldehyde for producing a urea resin; and a combination of melamine and an aldehyde. For example, a carrier core including cured phenolic resin may be produced by subjecting a phenol and an aldehyde in mixture with magnetic fine particles as described above, and optionally a dispersion stabilizer, to polycondensation in the presence of a basic catalyst in an aqueous medium.

Alternatively, the magnetic carrier core particles may also be produced through a process wherein starting materials including a thermoplastic resin, magnetic fine particles and other additives may be sufficiently blended by a blender, and melt-kneaded through kneading means, such as hot rollers, a kneader or an extruder, followed by cooling, pulverization and classification to obtain carrier core particles. The resultant resinous core particles may preferably be spherized (i.e., made spherical) thermally or mechanically to provide spherical core particles. The carrier may preferably have a shape factor SF-1 (as described hereinafter) of 100–130 so as to provide the two-component developer with improved developing performance.

Among the above-enumerated first resins, it is preferred to use a thermosetting resin, such as phenolic resin, melamine resin or epoxy resin in view of excellent durability, impact resistance and heat-resistance. In order to better exhibit the characteristic performances attained by the present invention, it is further preferred to use phenolic resin.

In order to provide the magnetic carrier with a resistivity and magnetic properties falling within the prescribed ranges, it is preferred to incorporate fine particles of a non-magnetic inorganic fine particles within the carrier core (particles), the magnetic fine particles and the non-magnetic inorganic compound fine particles may preferably be contained in total of 70–99 wt. %, more preferably 80–99 wt. %, of the resultant magnetic carrier, so as to provide a good combination of true specific gravity and resistivity of the carrier, and mechanical properties of the carrier core.

It is further preferred that the non-magnetic inorganic compound fine particles have a larger resistivity and a larger number-average particle size, respectively, than those of the magnetic fine particles, so as to provide the carrier with a higher resistivity and a smaller true specific gravity.

It is preferred that the magnetic fine particles are used in 30–95 wt. % of the total of the magnetic fine particles and the nonmagnetic inorganic compound fine particles so that the carrier receives appropriate level of magnetic force for preventing carrier attachment and has an appropriate level of resistivity.

More specifically, in order to provide a better surface uniformity of the carrier particles, it is preferred that the carrier has a number-average particle size of 15–60 $\mu$m, and the magnetic fine particles have a number-average particle size (ra) of 0.02–2 $\mu$m, particularly 0.05–1 $\mu$m. In order to provide an increased surface resistivity of the carrier core, it is preferred that the nonmagnetic inorganic compound fine particles have a number-average particle size ($r_b$) of 0.05–5 $\mu$m, which is at least 1.5 times that ($r_a$) of the magnetic fine particles.

As the magnetic fine particles used in the present invention, it is possible to use fine particles of a ferromagnetic iron oxide, such as magnetite or maghemite, and fine particles of spinel ferrites also containing at least one species of metal elements other than iron, such as Mn, Ni, Zn, Mg and Cu, fine particles of magneto-plumbite-form ferrite such as barium ferrite and fine particles of iron or iron alloys having a surface oxide film. Magnetite fine particles are particularly preferred. The magnetic fine particles may preferably have a number-average particle size of 0.02–3 $\mu$m, particularly 0.05–1 $\mu$m, in view of its dispersibility in an aqueous medium and the strength of spherical carrier core particles obtained in a preferred embodiment. The particle shape of the magnetic fine particles may be any of granular, spherical and acicular, while a spherical shape is preferred.

The non-magnetic inorganic compound fine particles may preferably have a resistivity of $10^8$–$10^{15}$ ohm.cm. It is possible to use fine particles of, e.g., titanium oxide, silica, alumina, zinc oxide, magnesium oxide, hematite, goethite or ilmenite. It is preferred to use non-magnetic fine particles not having a substantial difference in specific gravity with the magnetic fine particles, such as those of hematite, zinc oxide and titanium oxide. The non-magnetic inorganic compound fine particles may preferably have a number-average particle size of 0.05–5 $\mu$m, particularly 0.1–3 $\mu$m, in view of the dispersibility in an aqueous medium and the strength of the resultant carrier core particles.

In the present invention, it is particularly preferred that the magnetic fine particles comprise fine particles of magnetite, or fine particles of a magnetic ferrite containing at least iron and magnesium, and the non-magnetic inorganic compound fine particles comprise fine particles of hematite ($\alpha$-$Fe_2O_3$), so as to provide the carrier with appropriate levels of magnetite properties, true specific gravity and resistivity.

In order to provide a phenolic resin as a preferred species of the first resin for constituting the carrier core, it is possible to use a phenol compound having a phenolic hydroxyl group, examples of which may include: phenol per se; alkylphenols, such as o-cresol, m-cresol, p-tert-butylphenol, o-propylphenol, resorcinol and bisphenol A; and halogenated phenols obtained by substituting a halogen atom, such as chlorine or bromine, for one or more hydrogen atoms on the benzene nucleus or alkyl group of the phenol or alkylphenols. Among these, it is particularly preferred to use phenol (i.e., hydroxybenzene) per se.

For providing a phenolic resin, such a phenol compound may be reacted with an aldehyde compound, such as formaldehyde (e.g., in the form of formalin or paraformaldehyde) or furfural. Formaldehyde is preferred.

It is preferred to react 1–4 mols, particularly 1.2–3 mols of an aldehyde compound with one mol of a phenol compound. If the mol ratio is below 1, it is difficult to form the particles of the resin or only possible to form resin particles having a weak mechanical strength. On the other hand, if the aldehyde compound is excessive, the content of non-reacted aldehyde remaining in the aqueous medium after the reaction is liable to increase.

The polycondensation reaction between the phenol compound and the aldehyde compound is promoted in the presence of a basic catalyst, which may be one ordinarily used for production of resol resins. Examples thereof may include: ammonia water, hexamethylenetetramine, and alkylamines, such as dimethylamine, diethyltriamine and polyethyleneimine. Such a basic catalyst may preferably be used in a ratio of 0.02–0.3 mol per mol of the phenol compound.

The second resin surface-coating the magnetic carrier core particles has at least a fluoroalkyl unit, a methylene unit and an ester unit.

As a form of the fluoroalkyl unit effective for preventing the attachment of the toner external additive onto the carrier particle surfaces, it is preferred to use a perfluoroalkyl unit as represented by:

$$CF_3\text{-}(CF_2)_m$$

wherein m is an integer of 0–20. In order to provide an enhanced adhesion with the carrier core particle surfaces, the fluoroalkyl unit and the methylene unit are bonded to each other so as to provide a bonded unit of, e.g., $$CF_3\text{-}(CF_2)_m\text{-}(CH_2)_n,$$

wherein m is an integer of 0–20, and n is an integer of 1–15.

In order to provide an enhanced adhesion with the carrier core particle surfaces and provide the resultant magnetic carrier with a good ability of imparting negative triboelectric charge to the toner, it is preferred that the second resin has a combined unit as represented by:

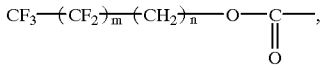

wherein m is an integer of 0–20, and n is an integer of 1–15.

It is preferred that the second resin is a polymer or copolymer of methacrylic acid or methacrylate ester having a fluoroalkyl unit, or a polymer or copolymer of ethacrylic acid or ethacrylate ester having a fluoroalkyl unit. Correspondingly, the second resin may preferably have a unit of at least one of the following two formulae:

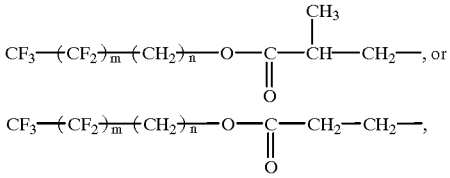

wherein m is an integer of 0–20, and n is an integer of 1–15.

In order to provide the magnetic carrier particles with further uniform surface properties, the second resin may preferably be in the form of a graft copolymer having a fluoroalkyl unit. An example of such a graft copolymer may be characterized by having, in combination, a unit represented by:

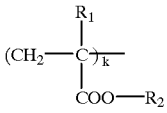

wherein $R_1$ denotes a hydrogen or alkyl group, $R_2$ denotes a hydrogen atom or an alkyl group of 1–20 carbon atoms, and k is an integer of at least 1; and a unit represented by:

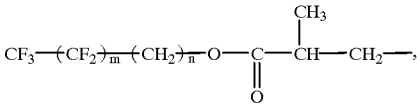

wherein m is an integer of 1–20, and n is an integer of 1–15.

More specifically, the graft copolymer may preferably have a structure including a main chain (or trunk polymer) comprising a (co)polymer (i.e., polymer or copolymer) having a perfluoroalkyl group, and a side chain (or branch polymer) comprising an alkyl methacrylate (co)polymer, an alkyl acrylate (co)polymer, or alkyl methacrylate-alkyl acrylate copolymer.

The second resin may preferably have a weight-average molecular weight (Mw) of $2\times10^4$–$3\times10^5$ based on gel permeation chromatography (GPC) of its THF (tetrafluorofuran)-soluble content so as to provide a coating layer exhibiting sufficient strength and adhesion with the carrier core particles and good applicability.

It is further preferred that the second resin has a molecular weight distribution as to provide a GPC chromatogram based in its THF-soluble content exhibiting a main peak in a molecular weight region of $2\times10^3$–$10^5$, and more preferably further a sub-peak or shoulder in a molecular weight region of $2\times10^3$–$10^5$.

It is further preferred that the GPC chromatograph of the THF-soluble content of the second region exhibits a main peak in a molecular weight range of $2\times10^4$–$10^5$ and a sub-peak or shoulder in a molecular weight region of $2\times10^3$–$1.9\times10^4$.

By satisfying the above-mentioned molecular weight distribution characteristics, the magnetic carrier coated with the second resin can exhibit further improved continuous image forming performances on a large number of sheets, stability of charging toner and freeness from attachment of the toner additive onto the carrier particles.

The second resin in the form of a graft copolymer may preferably have a weight-average molecular weight of $3\times10^4$ to $2\times10^5$ including a grafting polymer unit exhibiting a weight-average molecular weight of $3\times10^3$–$10^4$.

The molecular weight distribution and weight-average molecular weight of a THF-soluble content of a coating resin described herein are based on values measured by gel permeation chromatography performed according to the following conditions.

Apparatus: "GPC-150C" (mfd. by Waters Co.)

Column: 7 columns of "KF801" to "KF807" (mfd. by Showdex K.K.) in series

Temperature: 40° C.

Solvent: THF

Flow rate: 1.0 ml/min.

Sample: 0.1 mol of solutions at a concentration of 0.05–0.6 wt. %.

The molecular weight levels of chromatograms are determined based on a calibration curve prepared by using mono-disperse polystyrene disperse samples.

In a further preferred embodiment, the second resin may have a form of a graft polymer containing 5–80 wt. % of a trunk polymer comprising polymerized units of an α,β-unsaturated carboxylic acid ester having a fluoroalkyl unit-containing ester group. The preferred content is determined based on a sufficient releasability (i.e., anti-soiling characteristic) and adhesion with the carrier core.

The α,β-unsaturated carboxylic acid ester may preferably be an alkyl acrylate or an alkyl methacrylate. The alkyl group can have a hydrophilic substituent, such as a hydroxyl group. An alkyl methacrylate is preferred, particularly methyl methacrylate.

The α,β-unsaturated carboxylic acid ester having a fluoroalkyl unit-containing ester group may include fluoroalkyl acrylates and fluoroalkyl methacrylates. Specific examples thereof may include those represented by the following formula:

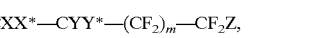

$$CHF{=}CH_2{-}COO{-}CXX^*{-}CYY^*{-}(CF_2)_m{-}CF_2Z,$$

wherein R denotes a hydrogen atom or a methyl group, X and X* denote a hydrogen or a fluorine atom, Y and Y* denote a hydrogen atom or a fluorine atom, m is an integer of 0–10, and Z denotes a hydrogen or a fluorine atom.

Among the (meth)acrylate monomers of the above formula, the four atoms of X, X*, Y and Y* may preferably include at least three hydrogen atoms, and it is further preferred that all 4 of these atoms are hydrogen atoms. This is because, the fluorine atoms contained in this part adjacent to the ester bond (COO) are liable to make the fluoro-alkyl unit-containing ester group less flexible, i.e., fragile. R may preferably be a methyl group since it tends to provide a tougher coating film than in the case of hydrogen atom. It is further preferred that m is 4 to 9 because a smaller m is liable to result in a lowering in release effect owing to the fluorine atom of the coating film.

Such a graft copolymer may be produced by reacting a macromer having a terminal ethylenically unsaturated group (providing a branch or branches) with an ethylenically unsaturated monomer (providing a trunk polymer). Alternatively, such a graft copolymer may also be produced by reacting a macromer having a terminal group capable of condensation reaction in the presence of a functional group cable of condensation reaction or a chain transfer agent. Herein, the "macromer" means a polymer or copolymer having a weight-average molecular weight of 3000–10,000 and also retaining a terminal reactive ethylenically unsaturated group. Such a macromer may be produced by ionic polymerization or radical polymerization.

More specifically, for example, a macromer is dissolved in an ethylenically unsaturated monomer having a perfluoroalkyl group, and the reactive ethylenically unsaturated are mutually reacted with each other to form a graft copolymer having a main chain including perfluoroalkyl group and branch(es) of the macromer unit(s). The macromer may be formed of polymerized units of alkyl methacrylates or alkyl acrylates, but the polymerized alkyl methacrylate units are preferred so as to provide a macromer having a higher glass transition unit.

The coupling agent to be used for treating the magnetic carrier core particles prior to the coating with the second resin or in mixture with the second resin for coating the magnetic carrier core particles may suitably be a silane coupling agent or a titanate coupling agent.

Preferred examples of the silane coupling agent may include: γ-aminopropyltrialkoxysilane, N-β-(aminoethyl)-γ-aminopropyltrialkoxysilane, N-β-(aminoethyl)-γ-aminopropylmethyldialkoxysilane, and N-phenyl-γ-aminopropyltrialkoxysilane.

Preferred examples of the titanate coupling agent may include: isopropyltri(N-aminoethyl-aminoethyl) titanate, and isopropyl-4-aminobenzenesulfonyl-di (dodecylbenzenesulfonyl) titanate.

In the magnetic carrier according to the present invention, the carrier core particles include the first resin having methylene units in the polymer chain, and the carrier core particles are coated with the coupling agent having an amino group and a methylene unit, and also the second resin having a fluoroalkyl unit, a methylene unit and an ester unit. The coupling agent forms a polymer by reaction between molecules thereof or is reacted with the first resin or the second resin to provide an enhanced adhesion and affinity with the first and second resins. Further, the amino group of he coupling agent suppresses the negative chargeability given by the fluoroalkyl group and enhances the carrier ability of imparting a negative charge to the toner.

In the magnetic carrier of the present invention, a preferred combination is provided by using a phenolic resin as the first resin (i.e., binder resin for the carrier core particles) and a fluoro-alkyl group-containing graft polymer as the second resin for coating the carrier core. As a result, due to repulsion of the fluoroalkyl unit contained in the grafting polymer by the polar hydroxyl group of the phenolic resin in the carrier core, the fluoroalkyl group is rather preferentially present at the surface portion of the coating layer to exhibit an enhanced release effect. The combination is also effective for enhancing the adhesion with the carrier core particles and the charging performance of the resultant carrier. These effects are enhanced by the co-presence of the silane coupling agent having an amino group.

It is preferred that the magnetic carrier core particles are coated with 0.01–5 wt. % of the second resin and 0.01–5 wt. % of the coupling agent respectively based on the resultant magnetic carrier, so as to stabilize the ability of triboelectrically charging a negatively chargeable toner, improve the continuous image forming performances on a large number of sheets of the carrier and suppress the soilability with the external additive and the toner.

The magnetic carrier of the present invention may preferably have a bulk density of at most 3.0 g/cm$^3$, more preferably at most 2.0 g/cm$^3$, as measured according to JIS K5101. In excess of 3.0 g/cm$^3$, a large shearing force is caused within the developer whereby the carrier is liable to be soiled with spent toner or suffer from peeling of the coating resin.

The shape of the magnetic carrier may be appropriately selected so as to suit a prescribed system where it is used. It is however generally preferred that the magnetic carrier has a sphericity or shape factor SF-1 of 100–130, more preferably 100–120. If the magnetic carrier has a sphericity exceeding 130, the resultant developer is liable to have inferior flowability, whereby the developer is caused to show a lower triboelectric charging ability to the toner and is liable to form a non-uniform shape of magnetic brush, thus failing to provide high-quality images.

The sphericity or shape factor SF-1 of a magnetic carrier may be measured, e.g., by sampling at least 300 magnetic carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

$$SF\text{-}1=[(MXLNG)^2/AREA]\times\pi/4\times100,$$

wherein MXLNG denotes the maximum diameter of a carrier particle, and AREA denotes the projection area of the carrier particle. SF-1 closer to 100 represents a shape closer to a sphere.

The core of the magnetic carrier may preferably comprise magnetite or ferrite showing magnetism as represented by a general formula of $MO.Fe_2O_3$ or $MFe_2O_4$, wherein M denotes a divalent or monovalant metal, such as Ca, Mn, Fe, Ni, Co, Cu, Mg, Zn, Cd, or Li. M denotes a single species or plural species of metals. Specific examples of the magnetite or ferrite may include: iron-based oxide materials, such as magnetite, γ-iron oxide, Mn—Zn—Fe-based ferrite, Ni—Zn—Fe-based ferrite, Mn—Mg—Fe-based ferrite, Ca—Mn—Fe-based ferrite, Ca—Mg—Fe-based ferrite, Li—Fe-based ferrite, and Cu—Zn—Fe-based ferrite. Among these, magnetite is most preferably used also from an economical viewpoint.

Examples of other metal oxides may include: non-magnetic metal oxides including one or plural species of metals, such as Mg, Al, Si, Ca, Sc, Ti, V, Cr, Mn, Fe, Co, Ni, Cu, Zn, Sr, Y, Zr, Nb, Mo, Cd, Sn, Ba and Pb. Specific examples of non-magnetic metal oxides may include: $Al_2O_3$, $SiO_2$, CaO, $TiO_2$, $V_2O_5$, $CrO_2$, $MnO_2$, $\alpha$-$Fe_2O_3$, CoO, NiO, CuO, ZnO, SrO, $Y_2O_3$ and $ZrO_2$.

In preparation of carrier core particles through a reaction between a phenol compound and an aldehyde compound in the presence of a basic catalyst as described above, it is preferred that the magnetic fine particles and the non-magnetic inorganic compound fine particles are co-present in a total weight which is 0.5–200 times that of the phenol compound. A total weight of 4–100 times is further preferred in view of the strength of the thus-produced magnetic carrier core particles.

The magnetic fine particles and the non-magnetic inorganic compound fine particles may be used as they are without a surface treatment or may be used after a lipophilization or lipophilicity-imparting treatment. In case where the magnetic fine particles and the non-magnetic inorganic compound fine particles are used without lipophilization treatment, the formation of spherical particles can be facilitated by adding a suspension stabilizer, e.g., a hydrophilic organic compound, such as carboxymethylcellulose or polyvinyl alcohol, or a fluorine compound, such as calcium fluoride.

The lipophilization treatment may for example be performed by a method of blending the magnetic fine particles or non-magnetic inorganic compound fine particles with a coupling agent, such as a silane coupling agent or a titanate coupling agent added thereto for surface-coating, or a method of dispersing the magnetic fine particles or non-magnetic inorganic compound fine particles within an aqueous medium containing a surfactant to cause the fine particles adsorb the surfactant. The magnetic fine particles and the non-magnetic inorganic compound fine particles may be lipophilized simultaneously or separately, or only one of them may be lipophilized.

The surfactant may be a commercially available one. It is preferred to use a surfactant having a functional group capable of bonding with hydroxyl groups present at the surface of the magnetic fine particles or the non-magnetic inorganic compound fine particles. Ionic surfactants, such as cationic surfactants and anionic surfactant may be preferred.

An example of production of magnetic carrier core by polymerization will now be described.

For the reaction, a phenol compound, an aldehyde compound, water, the magnetic fine particles and the non-magnetic inorganic compound fine particles are charged in a reaction vessel and sufficiently stirred therein. Thereafter, a basic catalyst is added and the system is warmed and held at a reaction temperature of 70–90° C. under stirring to form a cured phenolic resin. At this time, in order to provide spherical composite particles having a high sphericity, it is preferred that the system temperature is gradually raised at a rate of 0.5–1.5° C./min., more preferably 0.8–1.2° C./min.

The reaction product after the curing is cooled to 40° C. or below, and the resultant aqueous dispersion is subjected to a conventional solid-liquid separation, such as filtration or centrifugation, followed by washing and drying to obtain spherical magnetic carrier core particles comprising the magnetic fine particles and the non-magnetic inorganic compound fine particles bound by a cured phenolic resin as the binder resin. The production may be performed by batchwise or as a continuous process.

The coating of the magnetic carrier core particles may for example be performed by applying a coating liquid formed by dissolving or suspending a resin in a solvent or a liquid medium onto the magnetic carrier core particles.

When a two-component developer is prepared by blending the magnetic carrier with a toner, the magnetic carrier and the toner may be blended in such a ratio as to provide a toner concentration of 2–15 wt. %, preferably 4–13 wt. %, so as to provide a good result. Below 2 wt. %, the resultant image density is liable to be low and in excess of 15 wt. %, fog and toner scattering in the apparatus are liable to occur, and the life of the developer is liable to be shortened.

It is preferred that the toner used for constituting the two-component developer of the present invention has a weight-average particle size a providing a ratio a/b of 0.1–0.3 with the number-average particle size b of the magnetic carrier. If the ratio is below 0.1, it becomes difficult to well charge the toner, and fog and toner scattering in a high humidity environment are liable to occur. On the other hand, in excess of 0.3, the toner is liable to have an excessively high charge especially in a low humidity environment, thus being liable to cause a lowering in image density and fog.

The toner used in the present invention may preferably have a weight-average particle size (D4) of 3–9.9 μm, more preferably 4.5–8.9 μm. Further, in order to effect good triboelectrification free from occurrence of reverse charge fraction and good reproducibility of latent image dots, it is preferred to satisfy such a particle size distribution that the toner particles contain at most 20% by number in accumulation of particles having particle sizes in the range of at most a half of the number-average particle size (D1) thereof and contain at most 10% by volume in accumulation of particles having particle sizes in the range of at least two times the weight-average particle size (D4) thereof. In order to provide a toner with further improved triboelectric chargeability and dot reproducibility, it is preferred that the toner particles contain at most 15% by number, further preferably at most 10% by number, of particles having sizes of at most ½×D1, and at most 5% by volume, further preferably at most 2% by volume of particles having sizes of at least 2×D4.

If the toner has a weight-average particle size (D4) exceeding 9.9 μm, the toner particles for developing electrostatic latent images become so large that development faithful to the latent images cannot be performed even if the magnetic force of the magnetic carrier is lowered, and extensive toner scattering is caused when subjected to electrostatic transfer. If D4 is below 3 μm, the toner causes difficulties in powder handling characteristic.

If the cumulative amount of particles having sizes of at most a half of the number-average particle size (D1) exceeds 20% by number, the triboelectrification of such fine toner particles cannot be satisfactorily effected to result in difficulties, such as a broad triboelectric charge distribution of the toner, charging failure (occurrence of reverse charge fraction) and a particle size change during continuous image formation due to localization of toner particle sizes. If the cumulative amount of particles having sizes of at least two times the weight-average particle size (D4) exceeds 10% by volume, the triboelectrification with the magnetic carrier becomes difficult, and faithful reproduction of latent images becomes difficult. The toner particle size distribution may be measured, e.g., by using a Coulter counter.

The binder resin for the toner used in the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins. A crosslinked styrene is also a preferable binder resin.

Examples of the comonomer constituting such a styrene copolymer together with styrene monomer may include other vinyl monomers inclusive of:

monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The toner used in the present invention may preferably contain a THF-soluble portion of the binder resin exhibiting a number-average molecular weight of $3\times10^3$–$10^6$, more preferably $6\times10^3$–$2\times10^5$.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

Such a crosslinking agent may preferably be added in 0.001–10 wt. parts per 100 wt. parts of the polymerizate monomer.

The toner can contain a charge control agent.

As a negative charge control agent, an organic metal compound or chelate compound may effectively be used for example. Preferred examples may include: monoazo metal compounds, acetylacetone metal compounds, and metal compounds of aromatic hydroxycarboxylic acids and aromatic dicarboxylic acids. Other examples may include: aromatic hydroxycarboxylic acids, aromatic mono- and polycarboxylic acids, and metal salts, esters, and phenol derivatives with bisphenols, etc., of these acids; urea derivatives, metal-containing salicylic acid compounds; metal-containing naphthoic acid compounds; boron compound; quaternary ammonium salts: calixarenes; silicon compounds; styrene-acrylic acid copolymer; styrene-methacrylic acid copolymer; styrene-acryl-sulfqnic acid copolymer; and non-metal carboxylic acid compounds. Metal compounds of aromatic hydroxycarboxylic acids are particularly preferred because they are colorless or only slightly colored.

Such a charge control agent may be used in 0.01–20 wt. parts, preferably 0.1–10 wt. parts, more preferably 0.2–4 wt. parts, per 100 wt. parts of the toner binder resin.

The colorant used in the present invention may include a black colorant, yellow colorant, a magenta colorant and a cyan colorant. As a black colorant, it is possible to use a magnetic material.

Examples of non-magnetic black colorant may include: carbon black, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, transparency of the resultant OHP film, and a dispersibility in toner particles. The above colorants may preferably be used in a proportion of 1–20 wt. parts per 100 wt. parts of the binder resin.

A black colorant comprising a magnetic material, unlike the other colorants, may preferably be used in a proportion of 40–150 wt. parts per 100 wt. parts of the binder resin.

The toner particles may contain a wax as desired. It is preferred to use a wax having a ratio (Mw/Mn) between weight-average molecular weight (Mw) and number-average molecular weight (Mn) of at most 1.45 and a solubility parameter of 8.4–10.5, so as to provide a toner showing an excellent fluidity capable of providing uniform fixed images free of gloss irregularity and less liable to soil the fixing member of the fixing apparatus or cause lowering in storage stability. Further, the toner thus obtained can exhibit good fixability to provide fixed images showing good light transmittance. When the toner is melted to form full-color images, the wax can partially or wholly coat the heating member to suppress the toner offsetting, thereby providing a satisfactory full-color OHP film. The toner also can show a good low-temperature fixability and allow the long life of the pressing member.

The wax contained in the toner may preferably have an Mw/Mn ratio of at most 1.45, more preferably at most 1.30, based on a molecular weight distribution as measured according to gel permeation chromatography (GPC), so as to provide uniform fixed images and good transferability of the toner, and suppress the soiling of a contact charging means for contact-charging the photosensitive member.

If the Mw/Mn of the wax exceeds 1.45, the toner is liable to have inferior fluidity, thus resulting in gloss irregularity of the fixed images, and is further liable to have a lower transferability and soil the contact charging member.

The values of Mw/Mn of waxes described herein are based on molecular weight distributions measured by GPC under the following conditions.

(GPC measurement conditions)

Apparatus: "GPC-150C" (available from Waters Co.)

Column: Double columns of "GMH-HT" 30 cm in series (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The wax used in the present invention may preferably have a melting point of 30–150° C., more preferably 50–120° C. If the melting point of the wax is below 30° C., the resultant toner is liable to have lower anti-blocking property and exhibit lower effects of suppressing the soiling of the developing sleeve and photosensitive member during continuous image formation on a large number of sheets. If the wax melting point exceeds 150° C., an excessively large energy is required in the case of toner production through the pulverization process, and in the case of toner production through the polymerization process, the uniform dispersion of the wax in the binder resin requires a larger apparatus because of an increased viscosity, and the inclusion of a large amount of wax becomes difficult.

The wax melting point described herein refers to a peak-top temperature of a main peak on a heat-absorption curve measured according to ASTM D3418-8. The measurement according to ASTM D3418-8 may be performed by using a differential scanning calorimeter (e.g., "DSC-7", mfd. by Perkin-Elmer Corp.). The detector temperature correction may be performed based on the melting points of indium and zinc, and the calorie correction may be performed based on a heat of fusion of indium. A sample is placed on an aluminum pan and is set in combination with a blank pan for control. The measurement is performed in a temperature range of 20–200° C. at a temperature-raising rate of 10° C./min.

The wax used in the present invention may preferably have a melt-viscosity at 100° C. of 1–30 mPa.sec, more preferably 3–30 mPa.sec.

If the wax melt-viscosity is below 1 mPa.sec, the resultant toner is liable to be damage by a shearing force acting between the toner and the carrier in the two-component developer system, and the embedding of the external additive at the toner particle surface and the toner breakage are liable to occur. If the wax melt-viscosity exceeds 50 mPa.sec, the disperse phase during toner production through the polymerization process is caused to have a high viscosity, so that it becomes difficult to obtain a small particle size toner of uniform particle sizes, thus being liable to result in a toner having a broad particle size distribution.

The wax melt-viscosity measurement may be performed by using a rotary viscometer (e.g., "TV-500" equipped with a conical plate-shaped rotor ("PK-1", available from HAAKE Co.).

It is also preferred that the wax used in the present invention has such a molecular weight distribution as measured by GPC providing a chromatogram showing at least two peaks or a combination of at least one peak and at least one shoulder and exhibiting a weight-average molecular weight (Mw) of 200–2000, and a number-average molecular weight of 150–2000. The above-mentioned molecular weight distribution may be provided by a single wax species or a plurality of wax species. Anyway, by such a molecular weight distribution, the crystallinity of the wax is inhibited to provide a toner with a better transparency. Two or more wax species may be blended may be performed according to any methods, e.g., melt-blending at a temperature above the melting points by means of a media disperser, such as a ball mill, a sand mill, an attritor, an apex mill, a coball mill, or a handy mill; or dissolving such waxes in a polymerizable monomer, followed by blending by means of a media disperser. At this time, it is possible to add additives, such as a pigment, a charge control agent, and a polymerization initiator.

A wax having Mw below 200 or Mn below 150 results in a toner exhibiting poor anti-blocking property. A wax having Mw or Mn exceeding 2000 develops crystallinity to result in a toner having a lower transparency. It is further preferred that the wax has Mw of 200–1500, particularly 300–1000, and Mn of 200–1500, particularly 250–1000.

Such a wax may be added in 1–40 wt. parts, preferably 2–30 wt. parts, per 100 wt. parts of the toner binder resin.

More specifically, in the case of toner production through the pulverization process wherein starting materials, such as a binder resin, a colorant and a wax are melt-kneaded, cooled, pulverized and classified to provide toner particles, the wax may preferably be added in 1–10 wt. parts, more preferably 2–7 wt. parts, per 100 wt. parts of the binder resin.

In the case of toner production through the polymerization process wherein a composition including a polymerizable monomer, a colorant and a wax, is polymerized to directly product toner particles, the wax may preferably be added in 2–40 wt. parts, more preferably 5–30 wt. parts, further preferably 10–20 wt. parts.

Compared with the pulverization process, in the polymerization process for toner production, the wax can be incorporated in a larger amount in the toner particles since a wax having a lower polarity than the binder resin can be easily enclosed within toner particles in an aqueous polymerization system. This is advantageous for providing a better anti-offset effect in the fixation step.

If the wax amount is too low the anti-offset effect is liable to be inferior. If the wax amount is excessively large, the resultant toner is liable to cause melt-sticking onto the photosensitive drum and the developing sleeve distribution is liable to be formed.

The waxes suitably used in the present invention may include, e.g., paraffin wax, polyolefin wax, products obtained by modification (such as oxidation and grafting) of these waxes, higher fatty acids and metal salts thereof, amide waxes, and ester waxes.

Among these, ester waxes are particularly preferred as they propiole full-color OHP image is higher qualities.

Such ester waxes preferably used in the present invention may for example be produced through processes including oxidation, synthesis from carboxylic acids and derivatives thereof, and ester group-introduction reactions as represented by Michael addition reaction.

In view of the diversity of available starting materials and easiness of reactions, the ester waxes may particularly preferably be formed through a dehydrocondensation reaction of a carboxylic acid and an alcohol compound as represented by formula (1) below, or a reaction between an oxyhalide and an alcohol compound as represented by formula (2) below:

$$nR_1\text{-COOH}+R_2(OH)_n \leftrightarrows R_2(OCO\text{-}R_1)_n+nH_2O \quad (1)$$

$$nR_1\text{-COCl}+R_2(OH)_n \leftrightarrows R_2(OCO\text{-}R_1)_n+nNCl \quad (2),$$

wherein $R_1$ and $R_2$ independently denote an organic group, such as an alkyl group, an alkenyl group, an aralkyl or an aromatic group, and n is an integer of 1–4. The organic group may include 1–50 carbon atoms, preferably 2–45 carbon atoms, further preferably 4–30 carbon atoms. The organic group may preferably be linear one.

In order to have the above ester-formation equilibrium reactions to the product side (right side), an excessive amount of the alcohol may be used or the reaction may be performed in an aromatic organic solvent capable of forming an azeotropic mixture with water while using a Dean—Stark water separator. In the case of using an acid halide, it is possible to use a system of aromatic organic solvent containing a base added thereto for accepting the by-produced acid to promote the ester formation reaction.

As mentioned above, the toner used in the present invention may be produced through the pulverization process or a special toner production process as represented by the polymerization process.

According to the pulverization process a binder resin, a wax, a colorant, such as a pigment, dye or magnetic material, and optionally, a charge control agent and other additives, are sufficiently blended by a blended, such as a Henschel mixer or a ball mill; the thus-obtained blend is melt-kneaded by a hot-kneading means, such as hot rollers, a kneader or an extruder, to disperse or dissolve the colorant and other additives in the mutually melted resin components; and the resultant kneaded product is cooled to be solidified, pulverized and classified to provide toner particles.

The resultant toner particles may be blended, as desired, with prescribed additives (i.e., external additive) to obtain a toner used in the present invention.

For production of spherical toner particles, it is possible to adopt a process of spraying a molten mixture into air by using a disk or a multi-fluid nozzle as disclosed in JP-B 56-13945, etc.; a process for directly producing toner particles according to suspension polymerization as disclosed in JP-B 36-10231, JP-A 59-53856, and JP-A 59-61842; a dispersion 5 polymerization process for directly producing toner particles in an aqueous organic solvent in which the monomer is soluble but the resultant polymer is insoluble; a process for producing toner particles according to emulsion polymerization as represented by soap-free polymerization wherein toner particles are directly formed by polymerization in the presence of a water-soluble polymerization initiator; and a hetero-aggregation process wherein primary polar emulsion polymerizate particles and then polar particles of the opposite polarity are added to cause aggregation.

The dispersion polymerization process provides toner particles having an extremely sharp particle size distribution but allows only a narrow latitude for selection of usable materials, and the use of an organic solvent requires a complicated production apparatus and troublesome operations accompanying the disposal of a waste solvent and inflammability of the solvent. Accordingly, it is preferred to adopt a process wherein a composition comprising at least a polymerizable monomer, a colorant and a wax is polymerized in an aqueous medium to directly produced toner particles. The emulsion polymerization process as represented by the soap-free polymerization is effective for providing toner particles having a relatively narrow particle size distribution, but the used emulsifier and polymerization initiator terminal are liable to be present at the toner particle surfaces, thus resulting in an inferior environmental characteristic.

For the purpose of the present invention, it is particularly preferred to adopt the suspension polymerization process, under the normal or elevated pressure, capable of relatively easily providing toner particles having a sharp particle size distribution. It is also possible to adopt a seed polymerization process wherein a monomer is further adsorbed onto once-obtained polymerizate particles and polymerized by using a polymerization initiator.

The toner particles used in the present invention may preferably have a microtexture comprising a wax enclosed within an outer shell resin as confirmed by a sectional view observed through a transmission electron microscope (TEM). In order to incorporate a large amount of wax for improving the fixation characteristic, it is preferred to provide such an outer shell/wax enclosure structure so as to retain good storage stability and flowability of the toner. In case of a toner not having such an enclosure structure, the wax cannot be dispersed uniformly to result in a toner having a broad particle size distribution and liable to cause melt-sticking onto the apparatus members. As a specific method for providing such a wax enclosure structure, a composition containing a wax having a smaller polarity than a principal monomer constituting the composition may be dispersed in an aqueous medium, and a small amount of a resin or monomer having a larger polarity is also included in the composition to form an outer shell, thus providing toner particles having a so-called core/shell structure. It is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the wax and the outer resin by utilizing a difference in crystallinity therebetween.

The toner particle production through a direct polymerization process may be performed in the following manner. Into a monomer, a wax, a colorant, a charge control agent, a polymerization initiator, and other optional additives may be added, and the mixture is uniformly dissolved or dispersed by a homogenizer, an ultrasonic disperser, etc., to form a polymerizable monomer composition, which is then dispersed in an aqueous medium containing a dispersion stabilizer by means of an ordinary stirrer, a homomixer, a homogenizer, a clear mixer, etc. The stirring speed and time may be adjusted so that the monomer composition will form droplets or particles having sizes identical to the objective toner particles sizes. Thereafter, the stirring is continued in such a degree that the formed particle state is retained and the sedimentation of the particles is prevented. The polymerization temperature may be set to 40° C. or higher, generally 50–90° C. The temperature may be increased at a later stage of the polymerization. It is also possible to distill off a portion of the aqueous medium at a later stage of or after the polymerization, in order to remove the unreacted portion of the monomer or by-products which are liable to provide odor. After the reaction, the produced toner particles (polymerizate particles) are washed, recovered by filtration and dried. In the suspension polymerization process, it is ordinarily preferred to use 300 to 3000 wt. parts of water as a dispersion medium per 100 wt. parts of the monomer composition.

Examples of polymerizable monomers constituting a polymerizable monomer composition for directly providing toner particles by the polymerization process may include: styrene monomers, such as styrene, o-, m- or p-methylstyrene, and m- or p-ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behanyl (meth)acrylate, 2-ethylhexyl (meth) acrylate, methylaminoethyl (meth)acrylate, and diethylaminoethyl (meth)acrylate; butadiene, isoprene, cyclohexene, (meth)acrylonitrile, and acrylamide.

Examples of the polar resin included in the polymerizable monomer composition may include: polymers of nitrogen-containing monomers, such as dimethylaminoethyl methacrylate and diethylaminoethyl methacrylate, and copolymers of such nitrogen-containing monomers with styrene and/or unsaturated carboxylic acid esters; polymers or copolymers with styrene monomers of nitrile monomers such as acrylonitrile, halogen-containing monomers such as vinyl chloride, unsaturated carboxylic acids such as acrylic acid and methacrylic acid unsaturated dibasic acids and anhydrides thereof, and nitro monomers; polyesters; and epoxy resins. Preferred examples may include: styrene-(meth)acrylic acid copolymer, maleic acid copolymer, saturated polyester resins, and epoxy resins.

In the toner production by direct polymerization, examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, t-butyl hydroperoxide, dicumyl peroxide, 2,4-dichlorobenzoyl peroxide, lauroyl peroxide, 2,2-bis(4,4-t-butylperoxycyclohexyl)propane, and tris(t-butylperoxy) triazine; polymeric initiators having a peroxide group in their side chains; persulfates, such as potassium persulfate and ammonium persulfate. These initiators may be used or in combination of two or more species. The polymerization initiator may generally be used in the range of about 0.5–20 wt. % based on the weight of the polymerizable monomer.

In order to control the molecular weight of the resultant binder resin, it is also possible to add a crosslinking agent, a chain transfer agent, etc., in an amount of 0.001–15 wt. parts per 100 wt. parts of the polymerizable monomer.

In production of toner particles by the emulsion polymerization, dispersion polymerization, suspension polymerization, seed polymerization or hetero-aggregation using a dispersion medium, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt, starch, polyacrylamide, polyethylene oxide, poly (hydroxystearic acid-g-methyl methacrylate-eu-methacrylic acid) copolymer, and nonionic and ionic surfactants.

In the emulsion polymerization process or hetero-aggregation process, anionic surfactants, cationic surfactants, ampoteric surfactants or nonionic surfactants may be used.

These dispersion stabilizers may preferably be used in the aqueous dispersion medium in an amount of 0.2–30 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

In order to use a colorant in a polymerizable monomer composition for directly providing toner particles by the polymerization process, it is necessary to pay attention to the polymerization-inhibiting function and transferability to the aqueous phase of the colorant, so that it is preferred to subject the colorant to surface modification, e.g., hydrophobization free from polymerization inhibition. Particularly, dyes and carbon black can have polymerization dyes and carbon black can have polymerization inhibition function in many cases. As a preferred surface treatment of dyes a polymerizable monomer may be polymerized in advance in the presence of such a dye, and the resultant colored polymer may be added to the monomer composition. Further, carbon black may also be treated in the above-described manner for the dyes or may also be treated with a substance reactive with a surface functional group of the carbon black, such as polyorganosiloxane.

It is further preferred that the wax in the toner has a melting point which is higher than the glass transition temperature of the toner binder resin by at most 100° C., preferably at most 75° C., further preferably at most 50° C.

If the temperature difference exceeds 100° C., the low-temperature fixability of the resultant toner may be impaired. If the temperature difference is too small, a good combination of toner storability and anti-high-temperature offset property can be provided for only a narrow range, so that the temperature difference may preferably be at least 2° C. The glass transition temperature of the binder resin may preferably be 40–90° C., more preferably 50–85° C.

If the glass transition temperature is below 40° C., the resultant toner is provided with only a low storage stability and inferior flowability, thus failing to provide good images. If the glass transition temperature of the binder resin exceeds 90° C., the resultant toner is liable to have inferior low-temperature fixability and provide a full-color transparency with poor optical transparency, as represented by projection images with sombre halftone images and poor saturation.

The values of glass transition temperatures described herein are based on values determined on a heat-absorption curve measured according to ASTM D3418-8. The measurement according to ASTM D3418-8 may be performed by using a differential scanning calorimeter (e.g., "DSC-7", mfd. by Perkin-Elmer Corp.). The detector temperature correction may be performed based on the melting points of indium and zinc, and the calorie correction may be performed based on a heat of fusion of indium. A sample is placed on an aluminum pan and is set in combination with a blank pan for control. The measurement is performed in a temperature range of 20–200° C. at a temperature-raising rate of 10° C./min.

Next, external additives added to the toner particles to provide the toner used in the present invention will be described.

The toner used in the present invention may suitably include, as external additives: fine particles of inorganic substances, such as silica, alumina and titanium oxide; and fine particles of organic substances, such as polytetrafluoroethylene, polyvinylidene fluoride, polymethyl methacrylate, polystyrene and silicone resins. By adding such fine particles as an external additive to the toner, such fine particles are caused to be present between the toner and the carrier, and between the toner particles, to provide the developer with an improved flowability and an improved life. The fine particles may preferably have an average particle size of at most 0.2 $\mu$m. If the average particle size exceeds 0.2 $\mu$m, the flowability-improving effect is reduced, whereby the image quality can be lowered due to inadequate developing or transfer performance in some cases. The method for measuring the average particle size of these fine particles will be described later.

These external additive fine particles may preferably have a specific surface area as measured by nitrogen adsorption according to the BET method ($S_{BET}$) of at least 30 $m^2/g$, particularly 50–400 $m^2/g$, and may suitably be added in 0.1–20 wt. parts per 100 wt. parts of the toner particles.

In order to provide a negatively chargeable toner, it is preferred to use at least hydrophobized silica as a species of external additive. This is because silica has a higher negative chargeability than other flowability-improving agents, such as alumina and titanium oxide, so that it exhibits a higher attachment force onto the toner particles, thus leaving less isolated external additive particles. Accordingly, it can better suppress the filming on the electrostatic image-bearing member and the soiling on the charging member. If the negative chargeability is enhanced, a portion of the external additive isolated from the toner particles is liable to be transferred onto the carrier. Even in such as case, however, the fluorine-containing resin coated carrier of the present invention can better suppress the attachment of the flowability-improving agent because of its low surface energy.

It is preferred that the silica is hydrophobized in order to have a high chargeability in a high humidity environment.

A preferred class of hydrophobization agents may include silicone oil, preferably represented by the following formula:

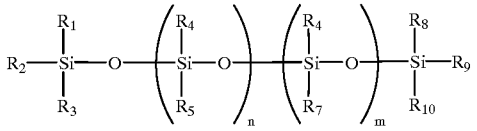

wherein $R_1$–$R_{10}$ independently denote hydrogen, hydroxyl, alkyl, halogen, phenyl, phenyl having a substituent, aliphatic group, polyoxyalkylene or perfluoroalkyl; and m and n are integers.

A preferred class of silicone oil may have a viscosity at 25° C. of 5–2000 $mm^2$/sec. Silicone oil having a lower viscosity because of too low a molecular weight can generate a volatile matter during a heat treatment. On the other hand, silicone oil having a higher viscosity because of too high a molecular weight makes difficult a surface treatment therewith. Preferred examples of silicone oil may include: methylsilicone oil, dimethylsilicone oil, phenylmethylsilicone oil, chlorophenylmethylsilicone oil, alkyl-modified silicone oil, aliphatic acid-modified silicone oil, and polyoxyalkyl-modified silicone oil.

The silicone oil may preferably be negatively chargeable similarly as the toner particles so as to provide a toner with an enhanced chargeability.

Inorganic fine powder may be treated with silicone oil in a known manner.

For example, inorganic fine powder and silicone oil may be blended directly in a blender, such as a Henschel mixer; or silicone oil may be sprayed onto inorganic fine powder. It is also possible to dissolve or disperse silicone oil in an appropriate solvent and mixing inorganic fine powder therein, followed by removing the solvent.

Silicone oil may suitably be used in 1.5–60 wt. parts, preferably 3.5–40 wt. parts, per 100 wt. parts of the inorganic fine powder to be treated therewith. Within the range of 1.5–60 wt. parts, the surface treatment with the silicone oil can be performed uniformly to well prevent the filming and hollow image dropout, prevent the lowering in toner chargeability due to moisture absorption in a high humidity environment and prevent the lowering in image density during continuous image formation. Also in the case of a fixing system using a fixing film, it becomes possible to prevent the occurrence of image defects, such as fixation toner scattering. It becomes possible to prevent the lowering in toner flowability and occurrence of fog.

It is also possible to hydrophobize inorganic fine powder by treatment with a silane coupling agent. Such a silane coupling agent may be used in 1–40 wt. parts, preferably 2–35 wt. parts per 100 wt. parts of the inorganic fine powder to be treated therewith, so as to provide improved moisture-resistance while preventing the occurrence of the agglomerate.

A suitable class of silane coupling agents used in the present invention may include those represented the following formula:

$$R_mSiY_n,$$

wherein R denotes alkoxy or chlorine, m is an integer of 1–3; Y denotes a hydrocarbon group, such as alkyl vinyl, glycidoxy or methacryl; and n is an integer of 1–3.

Specific examples of such silane coupling agents may include: dimethyldichlorosilane, trimethylchlorosilane, allyldimethylchlorosilane, hexamethyldisilazane, allylphenylichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

The treatment of inorganic fine powder with a silane coupling agent may be performed in known manners, e.g., a dry treatment process wherein a vaporized silane coupling agent is caused to react onto inorganic fine powder in a cloud state under stirring, or a silane coupling agent is added dropwise into a dispersion of inorganic fine powder in a solvent. These treatment processes may be combined as desired.

Various additives added into or added as external additives to toner particles may preferably have an average particle size which is at most ⅕ of that of the toner particles in view of continuous image forming performance of the resultant toner. The average particle sizes of the additives referred to herein are based on values determined electron microscopic photographs thereof (e.g., in a state of being mixed with toner particles in the case of external additives). Examples of such additives for improving toner performances may include the following.

Flowability improvers, inclusive of: metal oxides, such as silicon oxide, aluminum oxide, and titanium oxide; carbon black; and fluorinated carbon. These may preferably be hydrophobized before use.

Abrasives, inclusive of: strontium titanate, cerium oxide, aluminum oxide, magnesium oxide, and chromium oxide; nitrides, such as silicon nitride; carbides, such as silicon nitride; carbides, such as silicon carbide; and metal salts, such as calcium sulfate, barium sulfate and calcium carbonate.

Lubricants, inclusive of: power of fluorine-containing resins, such as polyvinylidene fluoride and polytetrafluoroethylene; and fatty acid metal salts, such as zinc stearate and calcium stearate.

Charge-controlling particles: inclusive of particles of metal oxides, such as tin oxide, titanium oxide, zinc oxide, silicon oxide and aluminum oxide and carbon black.

These additives may preferably be added in 0.1–1 wt. parts, more preferably 0.1–5 wt. parts, per 100 wt. parts of toner particles. These additives may be used singly or in combination of plural species.

The negatively chargeable toner used in the present invention may preferably have a triboelectric chargeability of −15 to −40 mC/kg, more preferably −20 to −35 mC/kg, when blended with the magnetic carrier of the present invention.

It is preferred that the negatively chargeable toner has a sphericity or shape factor SF-1 of 100–140 and is blended with at least hydrophobized silica fine powder as an external additive, so as to provide an improved developing performance.

The two-component developer including the magnetic carrier of the present invention may for example be used for development in a system as shown in FIG. 1, wherein development is performed under application of an alternating electric field and while a magnetic brush of the developer contacts an electrostatic image-bearing member, e.g., a photosensitive drum 1. A developer-carrying member (developing sleeve) 11 may preferably be disposed with a spacing of 100–1000 $\mu$m from the photosensitive drum 1 so as to well prevent the carrier attachment and provide an improved dot reproducibility. Below 100 $\mu$m, the developer supply is liable to be insufficient to result in a lower image density. Above 1000 $\mu$m, lines of magnetic forces exerted by a magnetic pole $S_1$ are broadened to provide a magnetic brush of a lower density, thereby being liable to result in images with an inferior dot reproducibility and carrier attachment due to weakening of a constraint force acting on the magnetic carrier.

The alternating electric field may preferably have a peak-to-peak voltage of 300–5000 volts, preferably 300–3000 volts and a frequency of 500–10000 Hz, more preferably 1000–7000 Hz, as suitably determined depending on the process. The alternating electric field may have an appropriate waveform, selected from various waveforms, such as triangular wave, rectangular wave, sinusoidal wave, waveforms obtained by modifying the duty ratio and intermittent alternating superposed electric field. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 200 volts, more preferably at most 150 volts.

It is preferred to use a contrast potential of 100–400 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) of the magnetic brush on the developing sleeve 11 with the photosensitive drum 1 at 3–8 mm in order to effect a development providing a sufficient image density and excellent dot reproducibility without causing carrier attachment. If the developing nip is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip may be appropriately adjusted by changing a distance between a developer regulating member 15 and the developing sleeve 11 and/or changing the gap between the developing sleeve 11 and the photosensitive drum 1.

In formation of a full color image for which a halftone reproducibility is a great concern may be performed by using at least 3 developing devices for magenta, cyan and yellow, adopting the developers according to the present invention and preferably adopting a developing system for developing digital latent images in combination, whereby a development faithful to a dot latent image becomes possible while avoiding an adverse effect of the magnetic brush and disturbance of the latent image. The use of a toner having a narrow particle size distribution with less fine powder fraction is effective in realizing a high transfer ratio in a subsequent transfer step. As a result, it becomes possible to obtain high image qualities both at the halftone portion and the solid image portion.

In addition to the high image quality at an initial stage of image formation, the use of the two-component developer according to the present invention is effective in reducing the shearing force applied onto the developer and also in avoiding the lowering in image quality in a continuous image formation on a large number of sheets.

In order to form full-color images with a sharp appearance, it is effective to use four developing devices for developing magenta, cyan, yellow and black, respectively, and effect the black development as a final step.

An embodiment of the image forming method according to the present invention will be described with reference to the drawings.

Referring to FIG. 1, a magnetic brush charger 30 formed of magnetic particles 23 is formed on the surface of a conveyer sleeve 22 and is caused to contact the surface of an electrostatic image-bearing member (photosensitive drum) 1 to charge the photosensitive drum 1. The conveyer sleeve 22 is supplied with a charging bias voltage from a bias voltage application means (not shown). The charged photosensitive drum 1 is illuminated with laser light 24 from an exposure means (not shown) to form a digital electrostatic image thereon, which is then developed with a toner 19*a* contained in a two-component developer 19 according to the present invention carried on a developing sleeve 11 enclosing a magnet roller 12 therein and supplied with a developing bias voltage from a bias voltage source (not shown).

A developing device 4 supplying the developer 19 is divided into a developer chamber $R_1$ and a stirring chamber $R_2$ by a partitioning wall 17, in which developer conveyer screws 13 and 14 are installed respectively. Above the stirring chamber $R_2$ is provided a toner storage chamber $R_3$ containing a replenishing toner 18, and at the bottom of the toner storage chamber $R_3$ is provided a toner replenishing port 20.

In the developing chamber $R_1$, the screw 13 is rotated to stir and convey the developer in the chamber $R_1$ in one direction along the length of the developing sleeve 11. The partitioning wall 17 is provided with openings (not shown) at a near side and a farther side as viewed in the drawing. The developer conveyed to one side of the developer chamber $R_1$ by the screw 31 is fed through the opening at the one side into the stirring chamber $R_2$ and now driven by the developer conveyer screw 14. The screw 14 is rotated in a direction reverse to that of the screw 13 to stir and mix the developer in the stirring chamber $R_2$, the developer conveyed from the developer chamber $R_1$ and a fresh toner replenished from the toner storage chamber $R_3$, and convey the mixture in a direction reverse to that by the screw 13 to supply the mixture into the developer chamber $R_1$ through the other opening of the partitioning wall 17.

For developing an electrostatic image formed on the photosensitive drum 1, the developer 19 in the developer chamber $R_1$ is drawn up by a magnetic force exerted by the magnet roller 12 to be carried on the surface of the developing sleeve 11. The developer carried on the developer sleeve 11 is conveyed to a regulating blade 15 along with the rotation of the developing sleeve 11 to be regulated into a thin developer layer having an appropriate layer thickness and reach a developing region where the developing sleeve 11 and the photosensitive drum 1 are disposed opposite to each other. At a part of the magnet roller 12 corresponding to the developing region is disposed a magnet pole (developing pole) $N_1$. The developing pole $N_1$ forms a developing magnetic field in the developing region, and ears of the developer are formed by the developing magnetic field to provide a magnetic brush of the developer in the developing region. The magnetic brush is caused to contact the photosensitive drum 1, whereby the toner in the magnetic brush and the toner on the developing sleeve 11 are transferred onto a region of electrostatic image on the photosensitive drum 1 to develop the electrostatic image, thereby providing a toner image 19*a* on the photosensitive drum 1.

A portion of the developer having passed the developing region is returned into the developing device 4 where the developer is peeled off the developing sleeve 11 by a repulsive magnetic field formed between magnetic poles $S_1$ and $S_2$, to fall into the developer chamber $R_1$ and the stirring chamber $R_2$ to be recovered.

If the developer 19 in the developing device 4 has caused a lowering in T/C ratio (toner/carrier mixing ratio, i.e., a toner concentration in the developer) due to continuation of the above-described operation, a fresh toner 18 in the toner storage chamber $R_3$ is replenished into the stirring chamber $R_2$ at a rate corresponding to the amount consumed during the development, so that the T/C ratio in the developer 19 is kept constant. The T/C ratio of the developer 19 in the device 4 may be detected by using a toner concentration detection sensor 28 equipped with a coil (not shown) therein having an inductance for measuring a change in magnetic permeability of the developer to detect the toner concentration.

The regulating blade 15 disposed below the developing sleeve 11 to regulate the layer thickness of the developer 19 on the developing sleeve 11 is a non-magnetic blade formed of a non-magnetic material, such as aluminum or SUS 316. The edge thereof may be disposed with a gap of 300–1000 $\mu$m, preferably 400–900 $\mu$m. If the gap is below 300 $\mu$m, the gap may be plugged with the magnetic carrier to result in an irregularity in the developer layer and a difficulty in applying an amount of toner required for performing good development, thus being liable to result in images with a low density and much irregularity. In order to prevent an irregular coating (so-called "blade-plugging") due to contaminant particles in the developer, the gap may preferably be 400 $\mu$m or larger. Above 1000 $\mu$m, however, the amount of developer applied onto the developing sleeve 11 is increased so that it becomes difficult to effect a prescribed developer layer thickness regulation, whereby the amount of magnetic carrier attachment onto the photosensitive drum 1 is increased and the circulation of the developer and the regulation of the developer by the regulating blade 15 are weakened to provide the toner with a lower triboelectric charge, leading to foggy images.

The magnetic carrier particle layer moves corresponding to the rotation of the developing sleeve in an indicated arrow direction but the speed of the movement becomes slower as the distance from the developing sleeve surface depending on a balance between a constraint force based on magnetic force and gravity and the conveying force in the direction of movement of the developing sleeve. Some developer can even fall due to the gravity.

Accordingly, by appropriately selecting the location of the magnetic poles N and $N_1$, and the flowability and the magnetic properties of the magnetic carrier particles, the magnetic carrier particle layer moves preferentially toward the magnetic pole $N_1$ to form a moving layer. Accompanying the movement of the carrier particles, the developer is conveyed to the developing region following the rotation of the developing sleeve 11.

The thus-developed toner image 19*a* on the photosensitive drum 1 is transferred onto a transfer material (recording material) 25 conveyed to the transfer position by a transfer blade 27, as a transfer means, supplied with a transfer bias electric field supplied from a bias voltage application means 26. Then, the toner image is fixed onto the transfer material 25 by means of a fixing device (not shown). Transfer residual toner remaining on the photosensitive drum 1 without being transferred onto the transfer material in the transfer step is charge-adjusted in the charging step and removed during the developing step.

Figure 3:
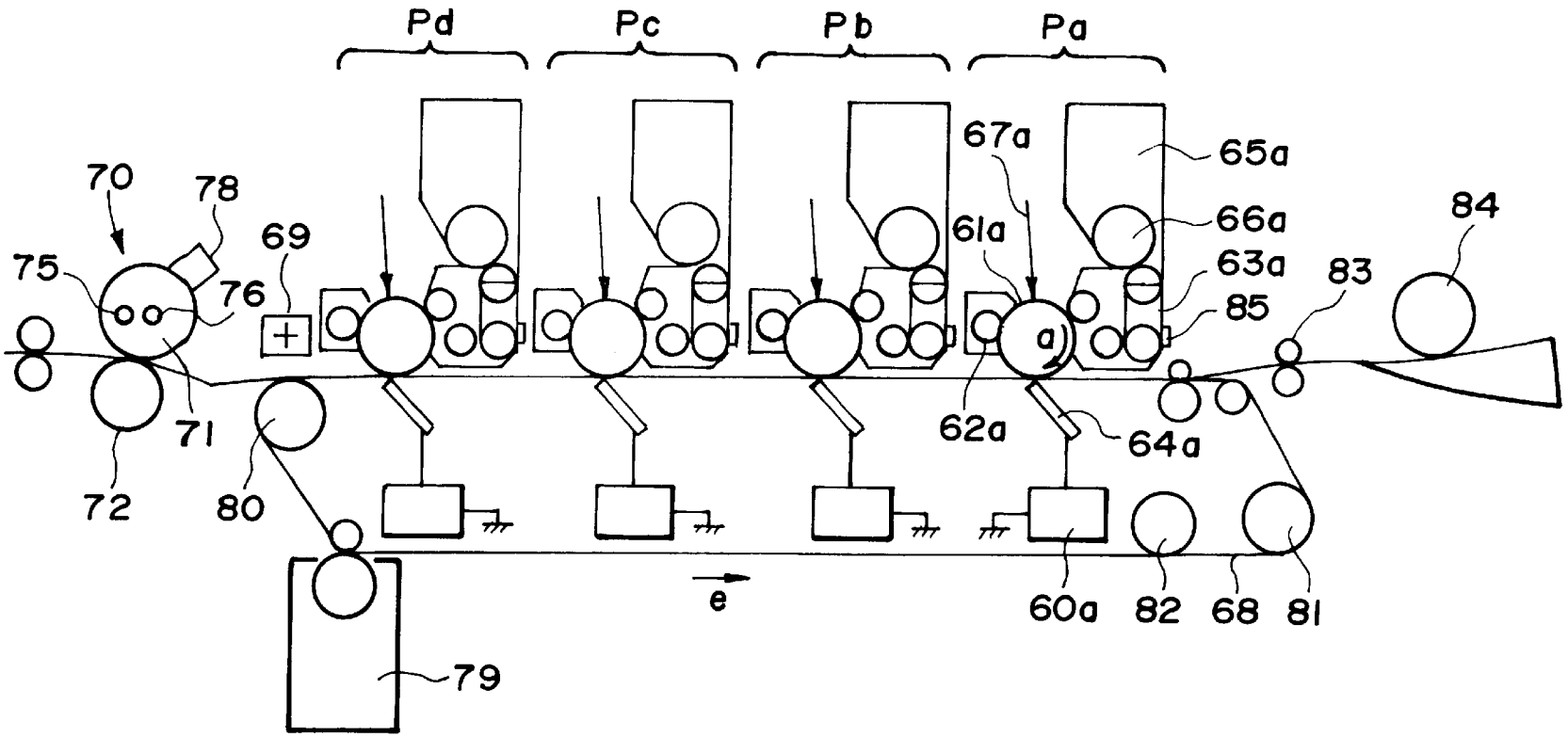
FIG. 3 illustrates a full-color image forming system.

FIG. 3 illustrates a full-color image forming system suitable for practicing another embodiment of the image forming method according to the present invention.

Referring to FIG. 3, a full-color image forming apparatus main body includes a first image forming unit Pa, a second image forming unit Pb, a third image forming unit Pc and a fourth image forming unit Pd disposed in juxtaposition for forming respectively images of difference colors each formed through a process including electrostatic image formation, development and transfer steps on a transfer material.

The organization of the image forming units juxtaposed in the image forming apparatus will now be described with reference to the first image forming unit Pa, for example.

The first image forming unit Pa includes an electrophotographic photosensitive drum 61*a* of 30 mm in diameter as an electrostatic image-bearing member, which rotates in an indicated arrow a direction. A primary charger 62*a* as a charging means includes a 16 mm-dia. sleeve on which a magnetic brush is formed so as to contact the surface of the photosensitive drum 61*a*. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 6*a* to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

When the toner is consumed on continuation of the development to lower the T/C ratio, the lowering is detected by a toner concentration detection sensor 85 including an inductance coil (not shown) for detecting a change in permeability of the developer, whereby an amount of replenishing toner 65*a* is supplied corresponding to the amount of consumed toner.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing deice 70 incudes, e.g., a pair of a 40 mm-dia. fixing roller 71 and a 30 mm-dia. pressure roller 72. The fixing roller 71 includes internal heating means 75 and 76. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 3, the transfer material-carrying member 68 is an endless belt member and is moved in the direction of an indicated arrow e direction by a drive roller 80 and a follower roller 81. During the movement, the transfer belt 68 is subjected to operation of a transfer belt cleaning device 79 and a belt discharger. In synchronism with the movement of the transfer belt 68, transfer materials are sent out by a supply roller 84 and moved under the control of a pair of registration roller 83.

As transfer means, such a transfer blade abutted against the back side of a transfer material-carrying member can be replaced by other contact transfer means capable of directly supplying a transfer bias voltage while being in contact with the transfer material-carrying member.

Further, instead of the above-mentioned contact transfer means, it is also possible to use a non-contact transfer means, such as a generally used corona charger for applying a transfer bias voltage to the back side of a transfer material-carrying member.

However, in view of the suppressed occurrence of ozone accompanying the transfer bias voltage application, it is preferred to use a contact transfer means.

Next, another embodiment of the image forming method according to the present invention will be described with reference to FIG. 4.

Figure 4:
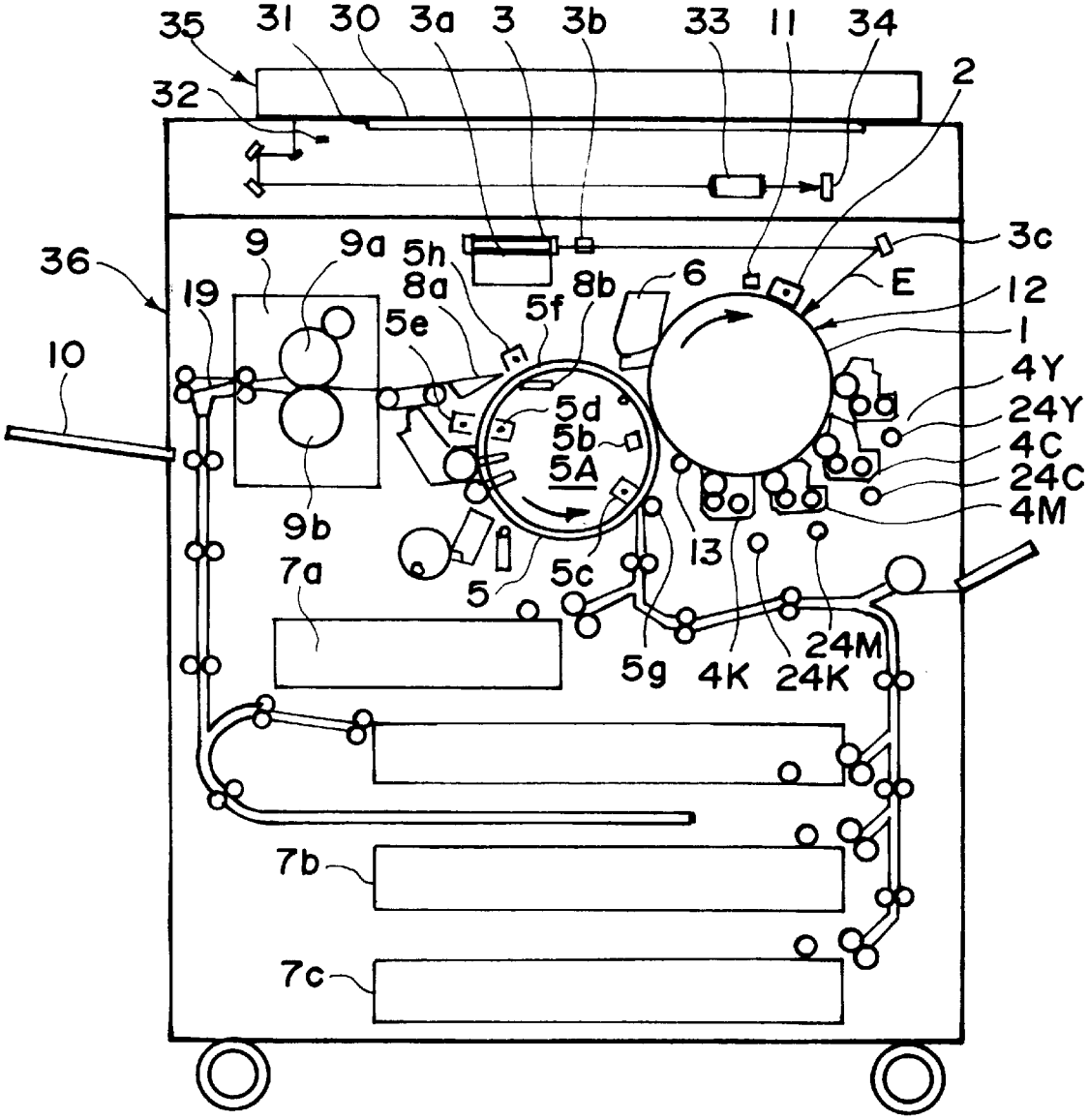
FIGS. 4 and 5 are respectively a schematic illustration of an image forming apparatus suitable for practicing another embodiment of the image forming method according to the invention.

FIG. 4 illustrates an image forming system constituted as a full-color copying system.

Referring to FIG. 4, the copying apparatus includes a digital color image reader unit 35 at an upper part and a digital color image printer unit 36 at a lower part.

In the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not shown) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a*, 3*b*, 3*c*), a potential sensor 12, four developing devices containing developers different in color (4Y, 4C, 4M, 4B), a luminous energy (amount of light) detection means 13, a transfer device 5A, and a cleaning device 6 are disposed.

In the laser exposure optical system 3, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing deice to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device 5A includes a transfer drum 5*a*, a transfer charger 5*b*, an adsorption charger 5*c* for electrostatically adsorbing a transfer material, an adsorption roller 5*g* opposite to the adsorption charger 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a transfer material-carrying member for carrying the recording material is integrally adjusted. The transfer sheet 5*f* may include a resin film, such as a polycarbonate film.

A transfer material is conveyed from any one of cassettes 7*a*, 7*b* and 7*c* to the transfer drum 5 via a transfer material-conveying system, and is held on the transfer drum 5. The transfer material carried on the transfer drum 5 is repeatedly conveyed to a transfer position opposite to the photosensitive drum 1 in accordance with the rotation of the transfer drum 5. The toner image on the photosensitive drum 1 is transferred onto the transfer material by the action of the transfer charger 5*b* at the transfer position.

The above image formation steps are repeated with respect to yellow (Y), magenta (M), cyan (C) and black (B) to form a color image comprising superposed four color toner images on the recording material carried on the transfer drum 5.

In the case of image formation on one surface, the recording material thus subjected to transfer of the toner image (including four color images) is separated from the transfer drum 5 by the action of a separation claw 8*a*, a separation and pressing roller 8*b* and the separation charger 5*h* to be conveyed to a heat-fixation 9. The heat-fixation device 9 includes a heat fixing roller 9*a* containing an internal heating means and a pressure roller 9*b*. By passing between the heat fixing roller 9*a* and the pressure roller 9*b*, the full-color image carried on the transfer material is fixed onto the transfer material. Thus, in the fixing step, the toner image on the transfer material is fixed under heating and pressure to effect color-mixing and color development of the toner and fixation of the toner onto the transfer material to form a full-color fixed image (fixed full-color image), followed by discharge thereof into a tray 10. As described above, a full-color copying operation for one sheet of recording material is completed. On the other hand, a residual toner on the surface of the photosensitive drum 1 is cleaned and removed by the cleaning device 6, and thereafter the photosensitive drum 1 is again subjected to next image formation.

In the image forming method according to the present invention, it is possible to transfer a toner image formed by development of an electrostatic image on an electrostatic image-bearing member onto a transfer material via an intermediate transfer member.

Such an embodiment of the image forming method includes a step of transferring a toner image formed by development of an electrostatic image once formed on an electrostatic image-bearing member onto an intermediate transfer member, and a step of transferring the toner image once transferred to the intermediate transfer member again onto a transfer material.

Such an embodiment of the image forming method using an intermediate transfer member will now be described with reference to an image forming system shown in FIG. 5.

Figure 5:
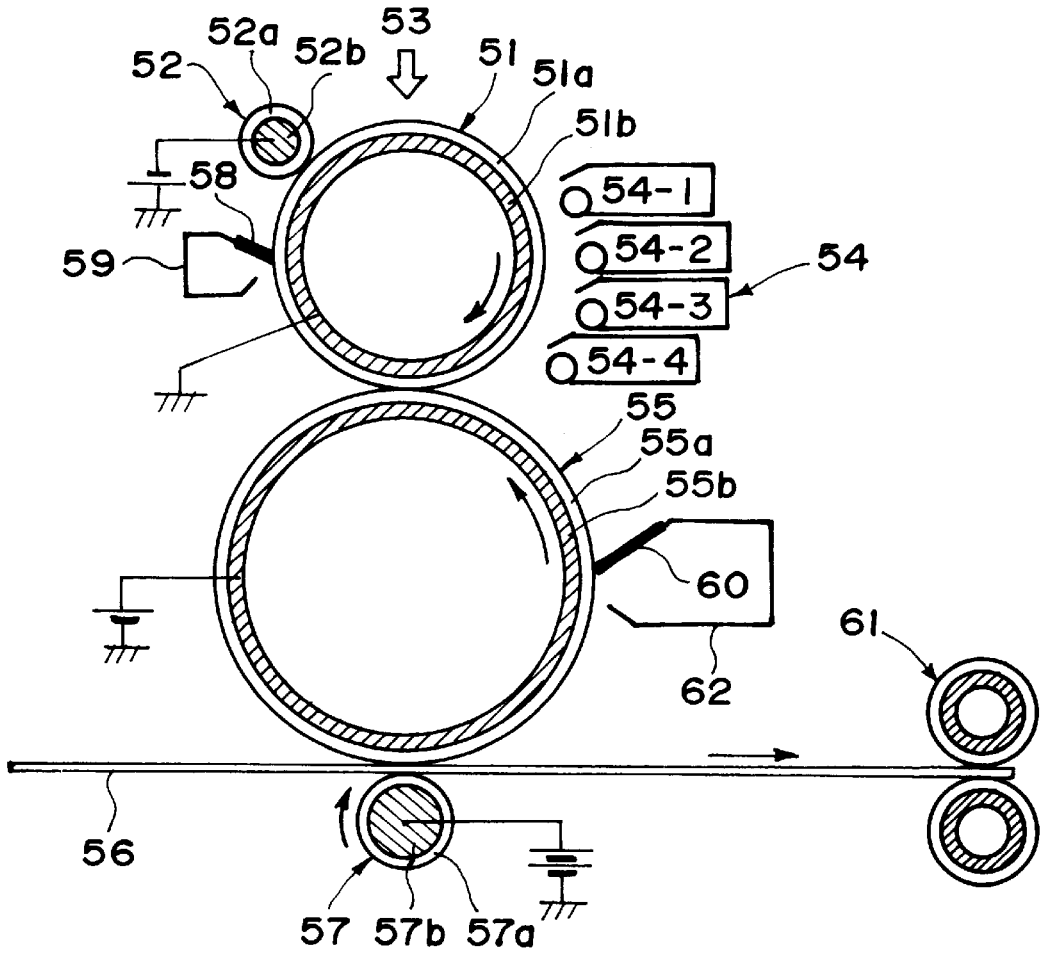

Referring to FIG. 5, the image forming system includes a cyan developing device 54-1, a magenta developing device 54-2, a yellow developing device 54-3 and a black developing device 54-4 containing a cyan developer including a cyan toner, a magenta developer including a magnetic toner, a yellow developer including a yellow toner, and a black developer including a black toner, respectively. A photosensitive member 51 as an electrostatic image-bearing member is illuminated with laser light 53 as an electrostatic latent image forming means to form an electrostatic image thereon. Such an electrostatic image is developed by one of these developers, e.g., by a magnetic brush development scheme, to form a color toner image on the photosensitive member 51.

The photosensitive member 51 comprises an electroconductive substrate 51*b* in the for of, e.g., a drum as shown, and an insulating phqtoconductor layer 51*a* disposed thereon comprising, e.g., amorphous selenium, cadmium sulfide, zinc oxide, organic photoconductor or amorphous silicon. The photosensitive member 51 is rotated in an indicated arrow direction by a drive means (not shown). The photosensitive member 51 may preferably comprise an amorphous silicon photosensitive layer or organic photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 51 or by using a contact charger, such as a charging roller. The contact charging system as shown in FIG. 5 may preferably be used in view of efficiency of uniform charging, simplicity and a lower ozone-generating characteristic.

The charging roller 52 as a primary charging means comprises a core metal 52*b* and an electroconductive elastic layer 52*a* surrounding a periphery of the core metal 52*b*. The charging roller 52 is pressed against the photosensitive member 51 at a prescribed pressure (pressing force) and rotated mating with the rotation of the photosensitive member 51.

The charging step using the charging roller may preferably be performed under process conditions including an applied pressure of the roller of 5–500 g/cm, an AC voltage of 0.5–5 kVpp, an AC frequency of 50 Hz–5 kHz and a DC voltage of ±0.2–±1.5 kV in the case of applying AC voltage and DC voltage in superposition.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF), polyvinylidene chloride (PVDC), or fluorine-containing acrylic resin.

The toner image formed on the electrostatic image-bearing member 51 is transferred to an intermediate transfer members 55 to which a voltage (e.g., ±0.1–±5 kV) is applied.

The intermediate transfer member 55 comprises a pipe-like electroconductive core metal 55*b* and a medium resistance-elastic layer 5*a* (e.g., an elastic roller) surrounding a periphery of the core metal 55*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm.

The intermediate transfer member 55 is disposed under the electrostatic image-bearing member 51 so that it has an axis (or a shaft) disposed in parallel with that of the electrostatic image-bearing member 51 and is in contact with the electrostatic image-bearing member 51. The intermediate transfer member 55 is rotated in the direction of an arrow (counterclockwise direction) at a peripheral speed identical to that of the electrostatic image-bearing member 51.

The respective color toner images are successively intermediately transferred to the peripheral surface of the intermediate transfer member 55 by an elastic field formed by applying a transfer bias to a transfer nip region between the electrostatic image-bearing member 51 and the intermediate transfer member 5 at the time of passing through the transfer nip region.

Transfer residual toner remaining on the photosensitive member 51 without being transferred onto the intermediate transfer member is cleaned by a cleaning member 58 for the photosensitive member to be recovered in a cleaner vessel 59.

The transfer means (e.g., a transfer roller) 57 is disposed under the intermediate transfer member 55 so that it has an axis (or a shaft) disposed in parallel with that of the intermediate transfer member 55 and is in contact with the intermediate transfer member 55. The transfer means (roller) 57 is rotated in the direction of an arrow (clockwise direction) at a peripheral speed identical to that of the intermediate transfer member 55. The transfer roller 57 may be disposed so that it is directly in contact with the intermediate transfer member 55 or in contact with the intermediate transfer member 55 via a belt, etc. The transfer roller 57 may comprise an electroconductive elastic layer 57a disposed on a peripheral surface of a core metal 57b.

The intermediate transfer member 55 and the transfer roller 57 may comprise known materials as generally used. By setting the volume resistivity of the elastic layer 55*a* of the intermediate transfer member 55 to be higher than that of the elastic layer 57*b* of the transfer roller 57, it is possible to alleviate a voltage applied to the transfer roller 57. As a result, a good toner image is formed on the transfer-receiving material and the transfer-receiving material is prevented from winding about the intermediate transfer member 55. The elastic layer 55*a* of the intermediate transfer member 55 may preferably have a volume resistivity at least ten times that of the elastic layer 57*b* of the transfer roller 57.

The hardness of the intermediate transfer member and the transfer roller may be measured according to JIS K6301. More specifically, the intermediate transfer member may preferably comprise an elastic layer having a hardness of 10–40 deg., and the transfer roller may preferably comprise an elastic layer having a hardness of 41–80 deg. harder than that of the elastic layer of the intermediate transfer member, so as to prevent the winding of a transfer material about the intermediate transfer roller. If the relative hardness of the intermediate transfer member and the transfer roller are reversed, concavities are liable to be formed on the transfer roller, thus promoting the winding of the transfer material about the intermediate transfer member.

The transfer roller 57 is rotated at a peripheral speed which may be identical or different from that of the intermediate transfer member 55. A transfer material 56 is conveyed to a transfer position between the intermediate transfer member 58 and the transfer roller 57, and simultaneously therewith, the transfer roller 57 is supplied with a bias voltage of a polarity opposite to that of the triboelectric charge of the toner from a transfer bias voltage supply means, whereby a toner image on the intermediate transfer member 55 is transferred onto a front-side surface of the transfer material 56.

Transfer residual toner remaining on the intermediate transfer member 55 without being transferred onto the transfer material 56 is cleaned by a cleaning member 60 for the intermediate transfer member and removed in a cleaning vessel 62. The toner image transferred onto the transfer material is fixed onto the transfer material when passing through a heat-fixing device 61.

The transfer roller 57 may comprise similar materials as those of the charging roller 52. Preferred transfer condition may include a roller abutting pressure of 2.94–490 N/m (3–500 g/cm), more preferably 19.6–294 N/m, and a DC voltage of ±0.2–±10 kV. If the abutting pressure is below 2.94 N/m, the conveyance deviation or transfer failure of transfer material is liable to occur.

The electroconductive elastic layer 57*a* of the transfer roller is formed as a solid or foam layer having a medium level of (volume) resistivity of $10^6$–$10^{10}$ ohm.cm of an elastic material, such as polyurethane rubber, or EPDM (ethylene-propylene-diene terpolymer) containing an electroconductivity-imparting material, such as carbon black, zinc oxide, tin oxide or silicon carbide, dispersed therein.

Now, methods for measuring various properties referred to herein will be described.

[Particle size of carrier]

At least 300 particles (diameter of 0.1 $\mu$m or larger) are taken at random from a sample carrier by observation through an optical microscope at a magnification of 100–5000, and an image analyzer (e.g., "Luzex 3" available from Nireco K.K.) is used to measure the horizontal FREE diameter of each particle as a particle size, thereby obtaining a number-basis particle size distribution and a number-average particle size, from which the number-basis proportion of particles having sizes in the range of at most a half of the number-average particle size is calculated.

[Magnetic properties of a magnetic carrier]

Measured by using an oscillating magnetic field-type magnetic property automatic recording apparatus ("BHV-30", available from Riken Denshi K.K.). A magnetic carrier is placed in an external magnetic field of 1 kilo-oersted to measure its magnification. The magnetic carrier powder sample is sufficiently tightly packed in a cylindrical plastic cell having a volume of ca. 0.07 $cm^3$ so as not to cause movement of carrier particles during the movement. In this state, a magnetic moment is measured and divided by an actual packed sample volume to obtain a magnetization per volume ($emu/cm^3$).

[Measurement of (electrical) resistivity of carrier]

Figure 6:
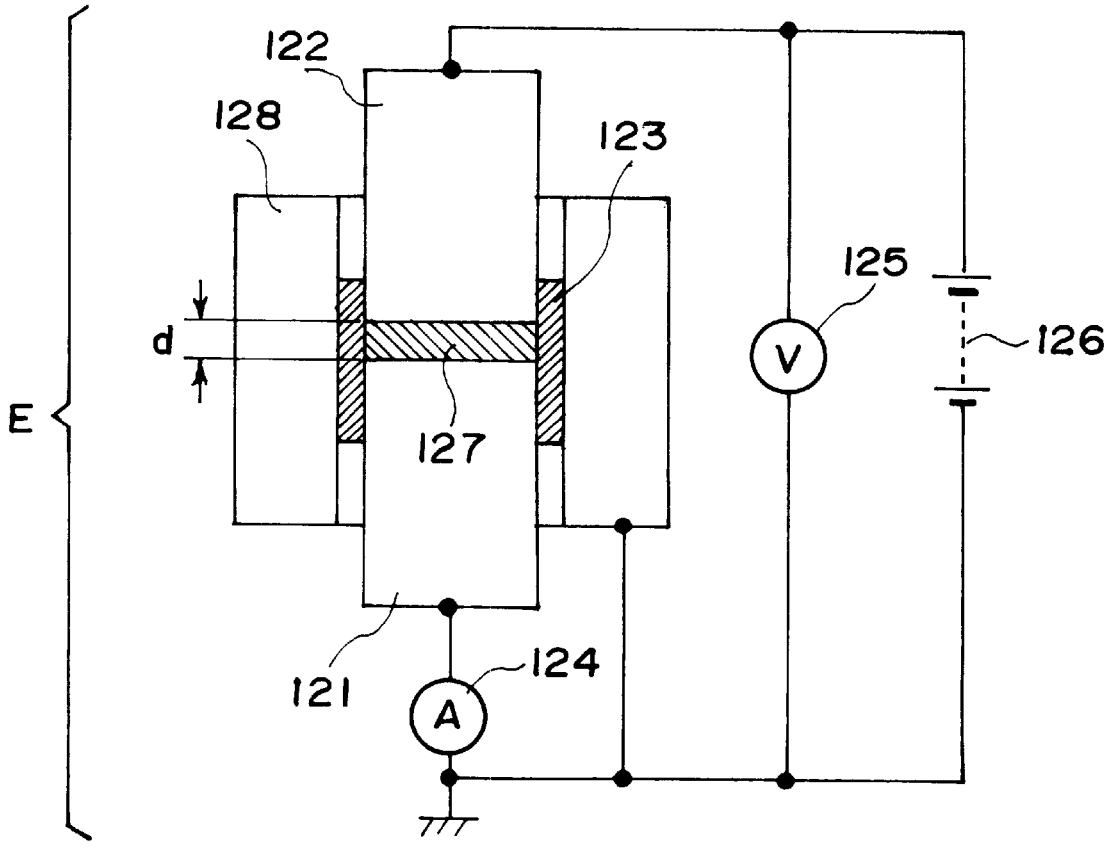
FIG. 6 illustrates an apparatus for measuring a volumetric resistivity.

The resistivity of a carrier (or carrier core) is measured by using an apparatus (cell) E as shown in FIG. 6 equipped with a lower electrode 121, an upper electrode 122, an insulator 123, an ammeter 124, a voltmeter 125, a constant-voltage regulator 126 and a guide ring 128. For measurement, the cell E is charged with ca. 1 g of a sample carrier (or carrier core) 127, in contact with which the electrodes 121 and 122 are disposed to apply a voltage therebetween, whereby a current flowing at that time is measured to calculate a resistivity. As a magnetic carrier is in powder form so that care should be taken so as to avoid a change in resistivity due to a change in packing state. The resistivity values described herein are based on measurement under the conditions of the contact area S between the carrier 127 and the electrode 121 or 112=ca. 2.3 $cm^2$, the carrier thickness d=ca. 2 mm, the weight of the upper electrode 122=180 g, and the applied voltage=100 volts.

[Particle size of magnetic fine particles or non-magnetic inorganic compound fine particles]

Photographs at a magnification of 5,000–20,000 of a sample powder are taken through a transmission electron microscope ("H-800", available from Hitachi Seisakusho K.K.). At least 300 particles (diameter of 0.01 $\mu$m or larger) are taken at random in the photographs and subjected to analysis by an image analyzer ("Luzex 3", available from Nireco K.K.) to measure a horizontal FREE diameter of each particle as its particle size. From the measured values for the at least 300 sample particles, a number-average particle size is calculated.

[Resistivity of magnetic or non-magnetic fine particles]

Measured similarly as the above-mentioned resistivity measurement for a carrier. Thus, a cell E as shown in charged with a fine particle sample 127 between electrodes 121 and 122 intimately contacting the sample 127. A voltage is applied between the electrodes, and a current flowing thereby is measured to calculate a resistivity. The packing of the sample fine particles 127 is performed while rotating the upper electrode 122 and lower electrode 121 reciprocally so that the electrodes contact the sample uniformly. In the above resistivity measurement, the conditions are set to S=ca. 2.3 $cm^2$, d=ca. 2 mm, the weight of the upper electrode 122=180 g, and the applied voltage=100 volts.

[Particle size of toner]

Into 100–150 ml of an electrolyte solution (1%-NaCl aqueous solution), 0.1–5 ml of a surfactant (alkylbenzenesulfonic acid salt) is added, and 2–20 mg of a sample toner is added. The sample suspended in the electrolyte liquid is subjected to a dispersion treatment for 1–3 min. and then to a particle size distribution measurement by a Coulter counter ("Coulter Multisizer") equipped with an appropriate size (e.g., 17 $\mu$m or 100 $\mu$m) of aperture corresponding to a sample toner size. Particle in the size range of 0.3 $\mu$m–40 $\mu$m are measured on a volume basis to obtain a number-average particle size (D1) and a weight-average particle size (D4) by computer processing. From the number-basis distribution, the percentage by number of particles having sizes of at most a half of the number-average particle size is calculated. Similarly, from the volume-basis distribution, the percentage by volume of particles having sizes of at least two times the weight-average particle size is calculated.

[Triboelectric charge]

1.6 g of a toner and 18.4 g of a magnetic carrier are placed in a polyethylene cup and left standing in each environment. In the case of high temperature/high humidity environment, a sample after the standing is hermetically sealed and further left standing for 2 hours so as not to cause dewing. Then, each sample mixture is subjected to mixing for 60 sec. by a Turbula mixer. The resultant powder mixture (developer) is placed in a metal container equipped with a 625-mesh electroconductive screen at the bottom, and the toner in the developer is selectively removed by sucking at a suction pressure of 250 mmHg through the screen by operating an aspirator. The triboelectric charge Q of the toner is calculated from a weight difference before and after the suction and a voltage resulted in a capacitor connected to the container based on the following equation:

$$Q(\mu C/g)=(C\times V)/(W_1-W_2),$$

wherein $W_1$ denotes the weight before the suction, $W_2$ denotes the weight after the suction, C denotes the capacitance of the capacitor, and V denotes the potential reading at the capacitor.

Further, a triboelectric charge of a toner in a developer during a continuous image forming operation is performed by taking 1 g of a sample developer on a developing sleeve, and placing the developer without further stirring in the sample container for the measurement in the above-described apparatus.

Hereinbelow, the present invention will be described more specifically based on Examples.

PRODUCTION EXAMPLE 1 (Coating resin)

10 wt. parts of methyl methacrylate macromer having a weight-average molecular weight (Mw) of 5,000 and retaining an ethylenically unsaturated group at one terminal end, 60 wt. parts of 2-(perfluorooctyl)-ethyl methacrylate and 30 wt. parts of methyl methacrylate were placed in a four-necked flask equipped with a reflux condenser, a thermometer, a nitrogen intake pipe and a stirrer attached to the flask by ground glass joint, and further 100 wt. parts of methyl ethyl ketone and 2.0 wt. parts of azobisisobutylvaleronitrile were added under stirring, followed by 10 hours of reaction at 70° C. under nitrogen stream, to obtain Graft copolymer (A). Graft copolymer (A) provided a GPC (gel permeation chromatography) chromatogram exhibiting a weight-average molecular weight (Mw)=70,000, a main peak molecular weight (Mp)=40,000 and a shoulder molecular weight (Ms)=4,000.

Graft copolymer (A) exhibited a structure wherein the methyl methacrylate macromer was graft-polymerized onto a copolymer of 2-(perfluorooctyl)-ethyl methacrylate and methyl methacrylate.

PRODUCTION EXAMPLE 2 (Coating resin)

20 wt. parts of methyl methacrylate macromer having a terminal ethylenically unsaturated group (Mw=2000), 60 wt. parts of 2-(perfluorooctyl)ether methacrylate and 20 wt. parts of methyl methacrylate were placed in a four-necked flask similar to the one used in Production Example 1, and further 100 wt. parts of methyl ethyl ketone and 7.0 wt. parts of azobisisovaleronitrile were added under stirring, followed by 10 hours of reaction at 70° C. under nitrogen stream, to obtain Graft copolymer (B), which provided a GPC chromatogram exhibiting Mw=10,000, Mp=10,000 and no peak in a molecular weight range of 20,000–100,000.

PRODUCTION EXAMPLE 3 (Coating resin)

10 wt. parts of methyl methacrylate macromer having a terminal ethylenically unsaturated group (Mw=8000), 70 wt. parts of 2-(perfluorooctyl)ether methacrylate and 20 wt. parts of methyl methacrylate were placed in a four-necked flask similar to the one used in Production Example 1, and further 100 wt. parts of methyl ethyl ketone and 0.7 wt. part of azobisisovaleronitrile were added under stirring, followed by 15 hours of reaction at 65° C. under nitrogen stream, to obtain Graft copolymer (C), which provided a GPC chromatogram exhibiting Mw=$3.2\times10^5$, Mp=$8\times10^4$ and Ms=$9\times10^3$.

PRODUCTION EXAMPLE 4 (Coating resin)

90 wt. parts of 2-(perfluorooctyl)ether methacrylate and 10 wt. parts of methyl methacrylate were placed in a four-necked flask similar to the one used in Production Example 1, and further 100 wt. parts of methyl ethyl ketone and 2.0 wt. parts of azobisisovaleronitrile were added under stirring, followed by 10 hours of reaction at 70° C. under nitrogen stream, to obtain Graft copolymer (D), which provided a GPC chromatogram exhibiting Mw=70,000, Mp=40,000 and no peak or shoulder in a molecular weight range of 20,000–100,000.

| Example 1 | |
|---|---|
| Phenol (hydroxybenzene) | 50 wt. parts |
| 37 Wt. % - formalin aqueous solution | 80 wt. parts |
| Water | 50 wt. parts |
| Magnetite fine particles surface-treated with a titanate coupling agent (Dav (number-average particle size) = 0.24 $\mu$m, Rs (resistivity) = $5\times10^5$ ohm/cm) | 280 wt. parts |
| $\alpha$-$Fe_2O_3$ fine particles surface-treated with a titanate coupling agent (Dav = 0.60 $\mu$m, Rs = $8\times10^9$ ohm · cm) | 120 wt. parts |
| 28 Wt. % - ammonia water | 15 wt. parts |

The above ingredients were placed in a four-necked flask, and under stirring, heated to 85° C. in 40 min. and reacted for curing at that temperature for 180 min. Thereafter, the system was cooled to 30° C., and 500 wt. parts of water was added thereto, followed by removal of the supernatant liquid, water washing and drying in air of the precipitate, and drying at 60° C. for 24 hours under a reduced pressure (5 mmHg), to obtain Magnetic carrier core (A) formed with a binder resin comprising a phenolic resin having a methylene unit. Magnetic carrier core (A) was found to have surface hydroxyl groups.

The thus-obtained Magnetic carrier core (A) was surface-treated within 5 wt. % solution in toluene of γ-aminopropyltrimethoxysilane of the following formula: $NH_2$—$CH_2CH_2CH_2$—Si—$(OCH_3)_3$, under continuous application of a shearing force while vaporizing the toluene.

The treated Magnetic carrier core (A) was found to be coated with 0.1 wt. % of γ-aminopropyl-trimethoxysilane and have the group of the following formula at its surface:

$NH_2CH_2CH_2$—Si—.

The thus-surface-treated Magnetic carrier core (A) was then surface-coated with 0.7 wt. % of Graft copolymer (A) by treatment within 10 wt. %-solution in toluene of Graft copolymer (A) while continuously vaporizing the toluene under application of a shearing force.

The coated product was then cured for 2 hours at 140° C., subjected to disintegration of the agglomerates thereof and sieved through a 200 mesh-screen to obtain Magnetic carrier (I), which exhibited Rs (resistivity)=$7.2\times10^{13}$ ohm.cm, $\sigma_{1000}$ (magnetization at 1 kilo-oersted)=42 $Am^2$/kg (emu/g), $\sigma_r$ (residual magnetization)=3.2 $Am^2$/kg (emu/g), SG (true specific gravity)=2.70 and $d_v$ (bulk density)=1.86 g/$cm^3$. Physical properties and a rough composition of the thus-obtained Magnetic carrier (I) are shown in Tables 1 and 2, respectively, together with magnetic carriers obtained in other Examples and Comparative Examples.

COMPARATIVE EXAMPLE 1

Comparative Magnetic carrier (i) was prepared in the same manner as in Example 1 except for coating Magnetic carrier core (A) directly with 0.7 wt. % of Graft copolymer (A) by treatment with 10 wt. % solution in toluene of Graft copolymer (A) without the preceding surface-coating with the γ-aminopropyltrimethoxysilane.

COMPARATIVE EXAMPLE 2

Comparative Magnetic carrier (ii) was prepared by surface-coating Magnetic carrier core (A) not treated with γ-aminopropyltrimethoxysilane with 0.7 wt. % of polytetrafluoroethylene (Mw=$3.2\times10^4$) by treatment with 10 wt. % solution in toluene of the polytetrafluoroethylene.

COMPARATIVE EXAMPLE 3

Comparative Magnetic carrier (iii) was prepared by surface-treating Magnetic carrier core (A) first with toluene solution of γ-aminopropyltrimethoxysilane similarly as in Example 1 and then with toluene solution of polytetrafluoroethylene similarly as in Comparative Example 2 to provide a coating with 0.7 wt. % of polytetrafluoroethylene.

COMPARATIVE EXAMPLE 4

Comparative Magnetic carrier (iv) was prepared by surface-coating Magnetic carrier core (A) not treated with γ-aminopropyltrimethoxysilane with 0.7 wt. % of silicone resin ("SR2410", mfd. by Toray Dow Corning K.K.) by treatment with a toluene solution of the silicone resin.

COMPARATIVE EXAMPLE 5

Comparative Magnetic carrier (v) was prepared by surface-treating Magnetic carrier core (A) first with toluene solution of γ-aminopropyltrimethoxysilane similarly as in Example 1 and then with toluene solution of silicone resin similarly as in Comparative Example 4 to provide a coating with 0.7 wt. % of silicone resin.

COMPARATIVE EXAMPLE 6

Comparative Magnetic ferrite carrier (vi) was prepared by surface-coating ferrite core particles (Dav=34 $\mu$m) with 0.1 wt. % of γ-aminopropyltrimethoxysilane and 0.7 wt. % of Graft copolymer (A) similarly as in Example 1. Comparative Magnetic ferrite carrier (vi) exhibited S.G.=4.90.

COMPARATIVE EXAMPLE 7

Comparative Magnetic ferrite carrier (vii) was prepared by surface-coating iron core particles (Dav=34 $\mu$m) with 0.1 wt. % of γ-aminopropyltrimethoxysilane and 0.7 wt. % of Graft copolymer (A) similarly as in Example 1. Comparative Magnetic ferrite carrier (vii) exhibited S.G.=5.00.

COMPARATIVE EXAMPLE 8

Magnetic carrier core (a) was prepared in the same manner as the preparation of magnetic carrier core (A) in Example 1 except for using magnetite fine particles surface-treated with titanate coupling agent (Dav=0.19 $\mu$m, Rs=3×

$10^4$ ohm.cm) instead of the mixture of the magnetite fine particles and the $\alpha$-$Fe_2O_3$ fine particles. Magnetic carrier core (a) was further surface-coated with 0.1 wt. % of $\gamma$-aminopropyltrimethoxylsilane and 0.7 wt. % of Graft copolymer (A) similarly as in Example 1 to prepare Comparative Magnetic carrier (viii), which exhibited Rs=1.0×$10^9$ ohm.cm.

COMPARATIVE EXAMPLE 9

Magnetic carrier core (b) was prepared in the same manner as the preparation of magnetic carrier core (A) in Example 1 except for using 200 wt. parts of magnetite fine particles surface-treated with titanate coupling agent (Dav=0.35 $\mu$m, Rs=3×$10^8$ ohm.cm) and 200 wt. parts of $\alpha$-$Fe_2O_3$ fine particles treated with a titanate coupling agent instead of the mixture of the magnetite fine particles and the $\alpha$-$Fe_2O_3$ fine particles. Magnetic carrier core (b) was further surface-coated with 0.1 wt. % of $\gamma$-aminopropyltrimethoxylsilane and 0.7 wt. % of Graft copolymer (A) similarly as in Example 1 to prepare Comparative Magnetic carrier (ix), which exhibited Rs=7.0×$10^{15}$ ohm.cm.

COMPARATIVE EXAMPLE 10

Magnetic carrier core (A) prepared in Example 1 was further coated with 0.1 wt. % of methyltrimethoxysilane instead of the $\gamma$-aminopropyltrimethoxysilane by treatment with a 5 wt. % solution in toluene of methyltrimethoxysilane and then with 0.7 wt. % of Graft copolymer (A) by treatment with a solution in toluene of Graft copolymer (A) in a similar manner as in Example 1 to prepare Comparative Magnetic carrier (x).

EXAMPLE 2

Magnetic carrier core (B) was prepared in the same manner as in Example 1 except for using varied amounts of 350 wt. parts of the magnetite fine particles surface-treated with a titanate coupling agent and 50 wt. parts of the $\alpha$-$Fe_2O_3$ surface-treated with a titanate coupling core (B) and was further coated with $\gamma$-aminopropyltrimethoxysilane and Graft copolymer (A) in the same manner as in Example 1 to obtain Magnetic carrier (II).

EXAMPLE 3

Magnetic carrier core (C) was prepared in the same manner as in Example 1 except for using varied amounts of 385 wt. parts of the magnetite fine particles surface-treated with a titanate coupling agent and 15 wt. parts of the $\alpha$-$Fe_2O_3$ surface-treated with a titanate coupling core (C) and was further coated with $\gamma$-aminopropyltrimethoxysilane and Graft copolymer (A) in the same manner as in Example 1 to obtain Magnetic carrier (III).

EXAMPLE 4

Magnetic carrier core (D) was prepared in the same manner as in Example 1 except for using varied amounts of 200 wt. parts of the magnetite fine particles surface-treated with a titanate coupling agent and 200 wt. parts of the $\alpha$-$Fe_2O_3$ surface-treated with a titanate coupling core (D) and was further coated with $\gamma$-aminopropyltrimethoxysilane and Graft copolymer (A) in the same manner as in Example 1 to obtain Magnetic carrier (IV).

EXAMPLE 5

Magnetic carrier core (E) was prepared in the same manner as in Example 1 except for using varied amounts of 150 wt. parts of the magnetite fine particles surface-treated with a titanate coupling agent and 250 wt. parts of the $\alpha$-$Fe_2O_3$ surface-treated with a titanate coupling core (E) and was further coated with $\gamma$-aminopropyltrimethoxysilane and Graft copolymer (A) in the same manner as in Example 1 to obtain Magnetic carrier (V).

EXAMPLE 6

Magnetic carrier core (F) was prepared in the same manner as in Example 1 except for using varied amounts of 110 wt. parts of the magnetite fine particles surface-treated with a titanate coupling agent and 290 wt. parts of the $\alpha$-$Fe_2O_3$ surface-treated with a titanate coupling core (F) and was further coated with $\gamma$-aminopropyltrimethoxysilane and Graft copolymer (A) in the same manner as in Example 1 to obtain Magnetic carrier (VI).

EXAMPLE 7

Magnetic carrier core (G) was prepared in the same manner except for using 280 wt. parts of magnetic Cu—Zn-ferrite fine particles treated with a titanate coupling agent (Dav=0.35 $\mu$m, Rs=2.0×$10^7$ ohm.cm) in place of the same amount of the magnetite fine particles, and the resultant Magnetic carrier core (G) was further coated with $\gamma$-aminopropyltrimethoxysilane and Graft copolymer (A) in the same manner as in Example 1 to obtain Magnetic carrier (VII).

EXAMPLE 8

Magnetic carrier core (H) was prepared in the same manner except for using 280 wt. parts of magnetic Mn—Mg-ferrite fine particles treated with a titanate coupling agent (Dav=0.42 $\mu$m, Rs=6.0×$10^7$ ohm.cm) in place of the same amount of the magnetite fine particles, and the resultant Magnetic carrier core (H) was further coated with $\gamma$-aminopropyltrimethoxysilane and Graft copolymer (A) in the same manner as in Example 1 to obtain Magnetic carrier (VIII).

EXAMPLE 8

Magnetic carrier core (I) was prepared in the same manner except for using 280 wt. parts of nickel fine particles treated with a titanate coupling agent (Dav=0.47 $\mu$m, Rs=2.5×$10^6$ohm.cm) in place of the same amount of the magnetite fine particles, and the resultant Magnetic carrier core (I) was further coated with $\gamma$-aminopropyltrimethoxysilane and Graft copolymer (A) in the same manner as in Example 1 to obtain Magnetic carrier (IX).

EXAMPLE 10

Magnetic carrier core (J) was prepared in the same manner except for using 120 wt. parts of alumina fine particles treated with a titanate coupling agent (Dav=0.37 $\mu$m, Rs=2×$10^{10}$ ohm.cm) in place of the same amount of the $\alpha$-$Fe_2O_3$ fine particles, and the resultant Magnetic carrier core (J) was further coated with $\gamma$-aminopropyltrimethoxysilane and Graft copolymer (A) in the same manner as in Example 1 to obtain Magnetic carrier (X).

EXAMPLE 11

Magnetic carrier (XI) coated with $\gamma$-aminopropyltrimethoxysilane and Graft copolymer (B)

was prepared in the same manner as in Example 1 except for using Graft copolymer (B) in place of Graft copolymer (A).

EXAMPLE 12

Magnetic carrier (XII) coated with γ-aminopropyltrimethoxysilane and Graft copolymer (C) was prepared in the same manner as in Example 1 except for using Graft copolymer (C) in place of Graft copolymer (A).

EXAMPLE 13

Magnetic carrier (XIII) coated with γ-aminopropyltrimethoxysilane and Graft copolymer (D) was prepared in the same manner as in Example 1 except for using Graft copolymer (D) in place of Graft copolymer (A).

| Example 14 | |
|---|---|
| Styrene monomer | 50 wt. parts |
| 2-Ethylhexyl acrylate | 12 wt. parts |
| Magnetite fine particles treated with a titanate coupling agent (Dav = 0.24 μm, Rs = $5 \times 10^5$ ohm · cm) | 280 wt. parts |
| α-$Fe_2O_3$ fine particles treated with a titanate coupling agent (Dav = 0.60 μm, Rs = $8 \times 10^9$ ohm · cm) | 120 wt. parts |

The above ingredients were mixed and heated to 70° C., and then 0.7 wt. part of azobisisobutyronitrile was added thereto form a polymerizable composition, which was then dispersed in a 1 wt. % polyvinyl alcohol aqueous solution and stirred by a homogenizer at 4500 rpm for 10 min. to form droplets thereof. Thereafter, the system was stirred by a paddle stirrer and subjected to polymerization for 10 hours at 70° C. The resultant polymerizate particles were filtered out from the polyvinyl alcohol aqueous solution, washed with water and dried to obtain Magnetic carrier core (K).

The resultant Magnetic carrier core (K) was further coated with γ-aminopropyltrimethoxysilane and Graft copolymer (A) in the same manner as in Example 1 to obtain Magnetic carrier (XIV).

EXAMPLE 15

50 wt. parts of styrene-butyl acrylate copolymer crosslinked with divinylbenzene (copolymerization weight ratio=83:17:0.5, Mw=$3.5\times10^5$), and 280 wt. parts of the magnetite fine particles treated with a titanate coupling agent and 120 wt. parts of the α-$Fe_2O_3$ fine particles treated with a titanate coupling agent, respectively identical to those used in Example 1, were melt-kneaded at 135° C. The melt-kneaded product was cooled, pulverized and classified to provide Magnetic carrier core (L), which was then further coated with γ-aminopropyltriethoxysilane and Graft copolymer (A) in the same manner as in Example 1 to obtain Magnetic carrier (XV).

EXAMPLE 16

Magnetic carrier (XVI) coated with 0.1 wt. % of γ-aminopropyltriethoxysilane and 0.7 wt. % of Graft copolymer (A) was prepared by surface-treatment of Magnetic carrier core (A) within a toluene solution containing both γ-aminopropyltrimethoxysilane and Graft copolymer (A) dissolved therein.

TABLE 1

Properties of magnetic carriers

| | Spefic gravity (SG) | $\sigma_{1000}$ ($Am^2$/kg) | $\sigma_r$ ($Am^2$/(kg) | Rs (Ω · cm) | Bulk density (g/$cm^3$) | Sphericity SF-1 | Dav. (μm) |
|---|---|---|---|---|---|---|---|
| Ex. 1 | 3.70 | 42 | 3.2 | $7.2 \times 10^{13}$ | 1.86 | 108 | 34 |
| Comp. Ex. 1 | 3.62 | 42 | 3.2 | $4.2 \times 10^{13}$ | 1.77 | 111 | 34 |
| Comp. Ex. 2 | 3.56 | 42 | 3.2 | $2.8 \times 10^{13}$ | 1.75 | 113 | 34 |
| Comp. Ex. 3 | 3.66 | 42 | 3.2 | $5.6 \times 10^{13}$ | 1.79 | 110 | 34 |
| Comp. Ex. 4 | 3.59 | 42 | 3.1 | $9.1 \times 10^{13}$ | 1.81 | 114 | 35 |
| Comp. Ex. 5 | 3.73 | 41 | 3.1 | $1.5 \times 10^{14}$ | 1.92 | 107 | 35 |
| Comp. Ex. 6 | 4.90 | 65 | 0 | $8.6 \times 10^{8}$ | 2.73 | 143 | 36 |
| Comp. Ex. 7 | 5.00 | 68 | 0 | $9.2 \times 10^{9}$ | 2.84 | 164 | 35 |
| Comp. Ex. 8 | 3.68 | 58 | 2.8 | $1.0 \times 10^{9}$ | 1.82 | 109 | 35 |
| Comp. Ex. 9 | 3.72 | 36 | 3.4 | $7.0 \times 10^{15}$ | 1.89 | 108 | 34 |
| Comp. Ex. 10 | 3.74 | 43 | 3.2 | $7.1 \times 10^{13}$ | 1.89 | 107 | 34 |
| Ex. 2 | 3.84 | 57 | 2.7 | $4.7 \times 10^{13}$ | 1.84 | 107 | 34 |
| Ex. 3 | 3.97 | 62 | 2.2 | $4.1 \times 10^{13}$ | 1.91 | 108 | 33 |
| Ex. 4 | 3.71 | 24 | 2.5 | $9.8 \times 10^{11}$ | 1.74 | 109 | 34 |
| Ex. 5 | 3.68 | 18 | 3.4 | $1.3 \times 10^{14}$ | 1.72 | 108 | 34 |
| Ex. 6 | 3.66 | 14 | 3.6 | $2.5 \times 10^{14}$ | 1.71 | 110 | 35 |
| Ex. 7 | 3.73 | 41 | 3.5 | $9.0 \times 10^{12}$ | 1.79 | 108 | 34 |
| Ex. 8 | 3.82 | 43 | 3.1 | $9.7 \times 10^{12}$ | 1.81 | 107 | 35 |
| Ex. 9 | 3.62 | 37 | 3.6 | $3.5 \times 10^{12}$ | 1.69 | 113 | 31 |
| Ex. 10 | 3.67 | 40 | 3.2 | $4.3 \times 10^{14}$ | 1.83 | 107 | 34 |
| Ex. 11 | 3.71 | 42 | 3.2 | $2.0 \times 10^{13}$ | 1.83 | 109 | 32 |
| Ex. 12 | 3.73 | 42 | 3.2 | $2.0 \times 10^{14}$ | 1.84 | 111 | 29 |
| Ex. 13 | 3.69 | 41 | 3.1 | $4.0 \times 10^{12}$ | 1.79 | 107 | 30 |
| Ex. 14 | 3.72 | 39 | 3.3 | $7.0 \times 10^{13}$ | 1.88 | 106 | 31 |
| Ex. 15 | 3.69 | 42 | 3.0 | $3.5 \times 10^{12}$ | 1.87 | 113 | 34 |
| Ex. 16 | 3.69 | 41 | 3.1 | $6.9 \times 10^{13}$ | 1.89 | 109 | 34 |

TABLE 2

Binder resin (first resin) and Coating agents

| Ex. & Comp. Ex. | First resin species | Second resin species*1 | Coupling agent*2 |
|---|---|---|---|
| Ex. 1 | phenolic resin | F-Graft copolymer (A) | γ-APTMS |
| Comp. Ex. 1 | " | " | — |
| Comp. Ex. 2 | " | PTFE | — |
| Comp. Ex. 3 | " | " | γ-APTMS |
| Ex. 4 | " | silicone resin | — |
| Ex. 5 | " | " | γ-APTMS |
| Ex. 6 | — | F-Graft copolymer (A) | " |
| Ex. 7 | — | " | " |
| Ex. 8 | phenolic resin | " | " |
| Ex. 9 | " | " | " |

TABLE 2-continued

| Binder resin (first resin) and Coating agents | | | |
|---|---|---|---|
| Ex. & Comp. Ex. | First resin species | Second resin species*1 | Coupling agent*2 |
| Ex. 10 | " | " | methylmethoxy-silane |
| Ex. 2 | phenolic resin | F-Graft copolymer (A) | γ-APTMS |
| Ex. 3 | " | " | " |
| Ex. 4 | " | " | " |
| Ex. 5 | " | " | " |
| Ex. 6 | " | " | " |
| Ex. 7 | " | " | " |
| Ex. 8 | " | " | " |
| Ex. 9 | " | " | " |
| Ex. 10 | " | " | " |
| Ex. 11 | " | F-Graft copolymer (B) | " |
| Ex. 12 | " | F-Graft copolymer (C) | " |
| Ex. 13 | " | F-Graft copolymer (D) | " |
| Ex. 14 | styrene acrylic resin | F-Graft copolymer (B) | " |
| Ex. 15 | styrene acrylic resin | " | " |
| Ex. 16 | phenolic resin | " | " |

*1F-Graft copolymer = Fluorine-containing Graft copolymer
*2γ-APTMS = γ-aminopropyltrimethoxysilane

TONER PRODUCTION EXAMPLE 1

Into 710 wt. parts of deionized water, 450 wt. parts of 0.1M-$Na_3PO_4$ aqueous solution was added and warmed at 60° C. under stirring at 1300 rpm by a stirrer ("TK-Homomixer", mfd. by Tokushu Kika Kogyo K.K.). Then, 68 wt. parts of 1.0 M-$CaCl_2$ aqueous solution was gradually added thereto to form an aqueous medium containing $Ca_3(PO_4)_2$.

| | |
|---|---|
| Styrene | 160 wt. parts |
| n-Butyl acrylate | 34 wt. parts |
| Copper phthalocyanine pigment | 12 wt. parts |
| Di-tert-butylsalicylic acid metal compound | 2 wt. parts |
| Saturated polyester (Av (acid value) = 11 mg KOH/g, Mp = 8500) | 10 wt. parts |
| Monoester wax (Mw = 500, Mn = 400, Mw/Mn = 1.25, Tmp (melting point) = 69° C., Vis (viscosity) = 6.5 mPa · s, Hv (Vickers hardness) = 1.1, Sp (solubility parameter) = 8.6) | 20 wt. parts |

The above ingredients were warmed at 60° C. and stirred at 12000 rpm (by TK-Homomixer) to be uniformly dissolved and dispersed, and then 10 wt. parts of 2,2'-azobis (2,4-dimethylvaleronitrile) (polymerization initiator) was dissolved therein to form a polymerizable monomer composition. The polymerizable monomer composition was charged into the above-prepared aqueous medium and the system was stirred for 10 min. at 10,000 rpm by a high-speed stirrer ("Clear Mixer", mfd. by Mtechnique K.K.) at 60° C. under a nitrogen atmosphere to form dispersed droplets of the polymerizable monomer composition. Then, under stirring at a paddle blade stirrer, the system was heated to 80° C. and subjected to 10 hours of polymerization while maintaining the system pH at 6.

After the polymerization, the system was cooled, and hydrochloric acid was added thereto to dissolve the calcium phosphate, followed by filtration, washing with water and drying to recover polymerizate particles (toner particles).

The resultant toner particles were found to contain 8.4 wt. parts of the monoester wax per 100 wt. parts of the binder, and were confirmed to have a core/shell structure of enclosing the wax in an outer shell resin layer as a sectional structure observed through a transmission electrode microscope (TEM). Further, the binder resin of the toner particles exhibited Sp=19 and Tg=60° C.

100 wt. parts of the above-prepared toner particles were blended with the following three species of external additives, and coarse particles were removed therefrom by sieving through a 330 mesh-screen to obtain non-magnetic negatively chargeable Cyan Toner No. 1. The properties and characterization of Cyan Toner No. 1 are inclusively shown in Table 3 together with other toners prepared in the following Toner Production Examples.

<External additive>

(1) First hydrophobic silica fine powder 0.3 wt. part ($S_{BET}$ (specific surface area by BET method)=200 $m^2/g$, Dav (number-average particle size)=12 nm. Formed by hydrophobizing 100 wt. parts of silica fine powder with 20 wt. parts of hexamethyldisilazane)

(2) Second hydrophobic silica fine powder 0.7 wt.part ($S_{BET}$=50 $m^2/g$, Dav=30 nm. Formed by hydrophobizing 100 wt. parts of silica fine powder with 10 wt. parts of hexamethyldisilazane)

(3) Hydrophobic titanium oxide fine powder 0.4 wt.part ($S_{BET}$=100 $m^2/g$, Dav=45 nm. Formed by hydrophobizing 100 wt. parts of titanium oxide fine powder with 10 wt. parts of isobutyltrimethoxysilane)

TONER PRODUCTION EXAMPLE 2

Cyan Toner No. 2 (negatively chargeable) was prepared by forming polymerizate particles (toner particles) in the same manner as in Toner Production Example 1 except for using an aqueous medium containing a larger amount of $Ca_3(PO_4)_2$ and stirring at 15,000 rpm (by Clear Mixer) for the monomer droplet formation, and blending the toner particles with the external additives in the same manner as in Toner Production Example 1. Cyan Toner No. 2 exhibited D4 (weight-average particle size)=2.8 μm.

TONER PRODUCTION EXAMPLE 3

Cyan Toner No. 3 (negatively chargeable) was prepared by forming polymerizate particles (toner particles) in the same manner as in Toner Production Example 1 except for using an aqueous medium containing a smaller amount of $Ca_3(PO_4)_2$ and stirring at 6,000 rpm (by Clear Mixer) for the monomer droplet formation, and blending the toner particles with the external additives in the same manner as in Toner Production Example 1. Cyan Toner No. 3 exhibited D4 (weight-average particle size)=10.1 μm.

TONER PRODUCTION EXAMPLE 4

Cyan Toner No. 4 (negatively chargeable) was prepared by blending 100 wt. parts of the toner particles prepared in Toner Production Example 1 with 1.4 wt. parts of hydrophobic titanium oxide fine powder ($S_{BET}$=100 $m^2/g$, Dav=45 nm, formed by hydrophobizing 100 wt. parts of titanium oxide fine powder with 10 wt. parts of isobutyltrimethoxysilane).

TONER PRODUCTION EXAMPLE 5

Cyan Toner No. 5 (negatively chargeable) was prepared by blending 100 wt. parts of the toner particles prepared in Toner Production Example 1 with the following three species of external additives.

(1) Hydrophillic silica fine powder 0.3 wt. part ($S_{ET}$=200 $m^2$/g, Dav=12 nm)

(2) Hydrophillic silica fine powder 0.7 wt. part ($S_{BET}$=50 $M^2$/g, Dav=30 nm)

(3) Hydrophobic titanium oxide fine powder 0.4 wt. part ($S_{BET}$=100 $^2$/g, Dav=45 nm. Formed by hydrophobizing 100 wt. parts of titanium oxide fine powder with 10 wt. parts of isobutyltrimethoxysilane)

| Toner Production Example 6 | |
|---|---|
| Terephthalic acid | 16 mol. % |
| Fumaric acid | 18 mol. % |
| Trimellitic anhydride | 15 mol. % |
| Bisphenol A derivative of the formula below (R = propylene, x + y = 2.2) | 30 mol. % |

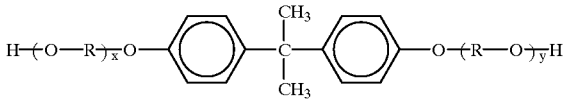

| | |
|---|---|
| Bisphenol A derivatives of the above formula (R = ethylene, x + y = 2.2) | 18 mol. % |

The above ingredients were subjected to polycondensation to form a polyester resin (Mn=5000, Mw=38000, Tg=60° C., Av=20 mgKOH/g, OH value=16 mgKOH/g).

| | |
|---|---|
| The above polyester resin | 100 wt. parts |
| Phthalocyanine pigment | 4 wt. parts |
| Di-ti-butylsalicylic acid aluminum complex | 4 wt. parts |

The above ingredients were sufficiently preliminarily blended by a Henschel mixer and then melt-kneaded through a twin-screw extruder kneader, followed by cooling, coarse crushing by a hammer mill into particles of ca. 1–2 mm, fine pulverization by an air jet pulverizer and classification to obtain negatively chargeable cyan toner particles having a weight-average particle size (D4) of 6.8 $\mu$m.

The cyan toner particles were blended with the three species of the external additives similarly as in Example 1 to prepare Cyan Toner No. 6 (negatively chargeable).

TONER PRODUCTION EXAMPLE 7

Magenta Toner was prepared by forming magenta toner particles (polymerizate particles) in the same manner as in Toner Production Example 1 except for using a quinacridone pigment in place of the copper phthalocyanine pigment, and blending the magenta toner particles with the three species of the external additive similarly as in Toner Production Example 1.

TONER PRODUCTION EXAMPLE 8

Yellow Toner was prepared by forming yellow toner particles (polymerizate particles) in the same manner as in Toner Production Example 1 except for using C.I. Pigment Yellow 93 in place of the copper phthalocyanine pigment, and blending the yellow toner particles with the three species of the external additive similarly as in Toner Production Example 1.

TONER PRODUCTION EXAMPLE 9

Black Toner was prepared by forming black toner particles (polymerizate particles) in the same manner as in Toner Production Example 1 except for using carbon black in place of the copper phthalocyanine pigment, and blending the black toner particles with the three species of the external additive similarly as in Toner Production Example 1.

TABLE 3

| Toners | | | | | | |
|---|---|---|---|---|---|---|
| | | | | External additive* (wt. parts) | | |
| Toner | D4 ($\mu$m) | Shape factor SF-1 | Shape factor SF-2 | Silica ($S_{BET}$ = 200 $m^2$/g) | Silica ($S_{BET}$ = 50 $m^2$/g) | Titanium oxide ($S_{BET}$ = 100 $m^2$/g) |
| Cyan Toner No. | | | | | | |
| 1 | 7.2 | 105 | 102 | HB 0.3 | HB 0.7 | HB 0.4 |
| 2 | 2.8 | 110 | 108 | HB 0.3 | HB 0.7 | HB 0.4 |
| 3 | 10.1 | 108 | 106 | HB 0.3 | HB 0.7 | HB 0.4 |
| 4 | 7.2 | 105 | 102 | — | — | HB 1.4 |
| 5 | 7.2 | 105 | 102 | HB 0.3 | HB 0.7 | HB 0.4 |
| 6 | 6.8 | 155 | 145 | HB 0.3 | HB 0.7 | HB 0.4 |
| Magenta Toner | 7.1 | 106 | 103 | HB 0.3 | HB 0.7 | HB 0.4 |
| Yellow Toner | 7.2 | 105 | 103 | HB 0.3 | HB 0.7 | HB 0.4 |
| Black Toner | 7.1 | 107 | 104 | HB 0.3 | HB 0.7 | HB 0.4 |

EXAMPLE 17

92 wt. parts of Magnetic carrier (I) and 8 wt. parts Cyan Toner No. 1 were blended to form Developer No. 1 (two-component-type).

COMPARATIVE EXAMPLES 11–20

Comparative Developers Nos. 1–10 (each of two-component type) were prepared by blending 92 wt. parts each of Comparative Carriers (i)–(x), respectively, with 8 wt. parts of Cyan Toner No. 1.

EXAMPLES 18–32

Developers Nos. 2–16 (each of two-component type) were prepared by blending 92 wt. parts each of Magnetic carriers (II)–(XVI), respectively, with 8 wt. parts of Cyan Toner No. 1.

EXAMPLES 33–37

Developers Nos. 17–21 (each of two-component type) were prepared by blending 92 wt. parts of Magnetic carrier (I) with 8 wt. parts each of Cyan Toners Nos. 2–6, respectively.

EXAMPLES 38–40

Developers Nos. 22–24 (each of two-component type) were prepared blending 92 wt. parts of Magnetic carrier (I) and 8 wt. parts each of Magenta Toner, Yellow Toner and Black Toner, respectively.

The triboelectric chargeability of the toner in each of the above-prepared was measured in the environment of normal temperature/normal humidity (23° C./65% RH), low temperature/low humidity (15° C./10% RH) and high temperature/high humidity (32.5° C./85% RH). The results are inclusively shown in the following Table 4.

TABLE 4

| Developer | Triboelectric chargeability of toners in two-component developers: Triboelectric chargeability (mC/kg) 23° C./65% RH | 15° C./10% RH | 32.5° C./85% RH |
|---|---|---|---|
| No. 1 | −27.5 | −33.2 | −22.6 |
| No. 2 | −25.4 | −31.6 | −21.4 |
| No. 3 | −24.7 | −30.5 | −20.3 |
| No. 4 | −29.1 | −33.6 | −23.7 |
| No. 5 | −29.9 | −34.2 | −24.1 |
| No. 6 | −30.7 | −36.0 | −24.8 |
| No. 7 | −26.5 | −31.3 | −20.6 |
| No. 8 | −25.8 | −32.1 | −20.5 |
| No. 9 | −24.6 | −32.5 | −20.3 |
| No. 10 | −23.8 | −29.4 | −19.2 |
| No. 11 | −28.3 | −34.1 | −23.8 |
| No. 12 | −29.1 | −36.3 | −19.2 |
| No. 13 | −29.2 | −35.7 | −19.6 |
| No. 14 | −24.2 | −37.4 | −20.5 |
| No. 15 | −23.1 | −36.8 | −20.9 |
| No. 16 | −27.1 | −32.6 | −22.1 |
| No. 17 | −30.3 | −45.3 | −19.1 |
| No. 18 | −23.1 | −29.1 | −13.6 |
| No. 19 | −19.1 | −24.1 | −11.1 |
| No. 20 | −26.3 | −31.1 | −9.3 |
| No. 21 | −30.3 | −36.1 | −18.9 |
| No. 22 | −25.7 | −33.0 | −20.4 |
| No. 23 | −29.6 | −34.7 | −22.8 |
| No. 24 | −24.3 | −31.6 | −20.1 |
| Comp. No. 1 | −14.5 | −23.1 | −7.4 |
| Comp. No. 2 | −11.6 | −17.4 | −4.9 |
| Comp. No. 3 | −21.4 | −24.1 | −16.3 |
| Comp. No. 4 | −27.4 | −33.2 | −19.6 |
| Comp. No. 5 | −30.5 | −37.2 | −20.6 |
| Comp. No. 6 | −24.3 | −31.6 | −18.7 |
| Comp. No. 7 | −25.4 | −30.3 | −20.6 |
| Comp. No. 8 | −23.1 | −26.1 | −15.9 |
| Comp. No. 9 | −29.4 | −32.6 | −24.8 |
| Comp. No. 10 | −13.6 | −22.6 | −6.9 |

EXAMPLE 41

Developer No. 1 prepared in Example 17 comprising Magnetic carrier (I) and Cyan Toner No. 1 was evaluated with respect to image forming performances in the following manner.

Figure 2:
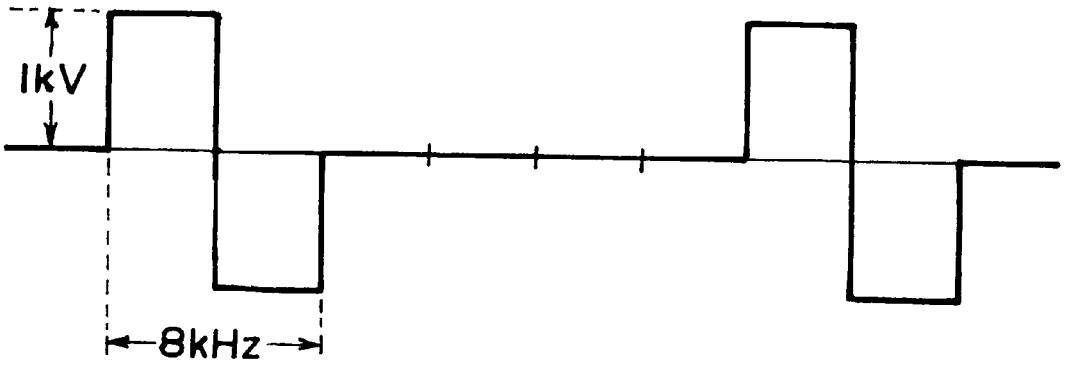
FIG. 2 illustrates an alternating electric field for development in the system shown in FIG. 1.

A commercially available digital copying machine ("GP-30F", mfd. by Canon K.K.; process speed: 30 A 4-size sheets/min) was remodeled so as to be equipped with a magnetic brush developing device 4 and a magnetic brush charger 30 as shown in FIG. 1. The developing sleeve 12 was supplied with an intermittent AC bias voltage as shown in FIG. 2 having a pause period (superposed on DC bias voltage of −550 volts). The magnetic brush charger 30 for charging an OPC photosensitive drum 1 included magnetic particles 23 prepared in the following manner.

(Preparation of magnetic particles)

5 wt. parts of MgO, 8 wt. parts of MnO, 4 wt. parts of SrO and 83 wt. parts of $Fe_2O_3$, respectively in fine powder form, were blended together with water and granulated, followed by calcination at 1300° C. and particle size adjustment, to obtain ferrite magnetic particles having Dav=28 μm, $\sigma_{1000}$=60 $Am^2/kg$ and Hc (coercive force)=55 oersted.

100 wt. parts of the above-prepared magnetic particles were coated with 0.1 wt. part of isoproxytriisostearoxy titanate by treatment within a treatment liquid prepared by mixing 10 wt. parts of the titanate with 99 wt. parts of hexane and 1 wt. part of water, to provide charger magnetic particles, which exhibited a volume resistivity of $3\times10^7$ ohm.cm and a heating loss of 0.1 wt. %.

The sleeve 22 of the magnetic brush charger 30 was rotated in a counter direction with and at a peripheral speed of 120% of that of the photosensitive drum 1 and was driven to charge the photosensitive drum 1 by applying a DC/AC superposed electric field of −700 volts and 1 kHz/1.2 kVpp (so as to provide a dark part potential of −700 volts and a light part potential of −350 volts). A developing contrast was set to 200 volts (=−350−(−550) volts) and a fog-inversion contrast was set to −150 volts (=−700−(−550) volts).

The copying machine also included a heat-pressure fixing device comprising a heating roller surfaced with a 1.2 μm-thick of layer of PFA (copolymer of tetrafluoroethylene and perfluoroalkyl vinyl ether) and a pressure roller surfaced with a 1.2 μm-thick PFA layer and was driven according to an oil-less fixation scheme by removing a silicone oil-application device from the heat-pressure fixing device.

For the image forming performance evaluation, an original of 30% image area was digitally processed to form a digital electrostatic latent image (a dark-part potential=−700 volts, a light part potential=−350 volts) on the OPC photosensitive drum, and the electrostatic image was developed with a negatively chargeable toner in each developer according to a reversal development scheme to form cyan toner images.

The developer was evaluated in continuous image formation on 30000 sheets in each of various environments including normal temperature/normal humidity (23° C./65% RH), normal temperature/low humidity (23° C./10% RH), low temperature/low humidity (15° C./10% RH), and high temperature/high humidity (32.5° C./85% RH).

The methods for evaluation are described hereinbelow and evaluation results are inclusively shown in Tables 5 to 8 together with the results in other Examples and Comparative Examples described hereinafter. In Tables 5 to 8, "initial" and "final" represent performance evaluaton after image formation on 3000 sheets and 30000 sheets, respectively.

(1) ID (image density)

The image density of a solid image portion of an image formed on plain paper was measured as a relative density by using a reflective densitometer equipped with an SPI filter. ("Macbeth Densitomer RD-918", available from Macbeth Co.).

(2) Carrier attachment

A solid white image reproduction was interrupted, and a transparent adhesive tape was intimately applied onto a region on the photosensitive drum between the developing station and cleaning station to sample magnetic carrier particles attached to the region. Then, the number of magnetic carrier particles attached onto a size of 5 cm×5 cm were counted to determine the number of attached carrier particles per $cm^2$. The results were evaluated according to the following standard:

A: less than 5 particles/$cm^2$,

B: 5-less than 10 particles/$cm^2$,

C: 10-less than 20 particles/$cm^2$,

D: 20 particles/$cm^2$ or more (3) Fog

An average reflectance Dr (%) of a plane paper before image formation was measured by a densitometer ("TC-6MC", available from Tokyo Denshoku K.K.). Then, a solid white image was formed on an identical plain paper, and an average reflectance Ds (%) of the solid while image was measured in the same manner. Then, Fog (%) was calculated by the following formula:

$$Fog(\%)=Dr(\%)-Ds(\%).$$

The results were evaluated according to the following standard:

A: below 0.4%,

B: 0.4-below 0.8%,

C: 0.8-below 1.2%,

D: 1.2-below 1.8%,

E: 1.8% or higher.

(4) Toner scattering

The appearance of toner scattering in the image forming apparatus was observed after continuous image formation on 3000 sheets (for initial stage evaluation) and on 30000 sheets (for final stage evaluation) and evaluated together with the influence thereof on the resultant images according to the following standard.

A: No scattering at all.

B: Some scattering was observed at a level of practically no problem.

C: Much scattered toner was observed in the apparatus but at a level of resulting in substantially no influence in the images.

D: Considerably much scattering was observed and the resultant images were also soiled at a practically problematic level.

E: Severe scattering.

(5) Carrier soiling

The surface of the magnetic carrier in the developing device after the continuous image formation on 3000 sheet (for initial stage evaluation) and on 30000 sheets (for final stage evaluation) was observed through a scanning electron microscope and evaluated together with its influence on the resultant images according to the following standard.

A: No soiling at all.

B: Some soiling was observed but at level of practically no problem.

C: Much spent toner attachment was observed on the carrier but at a level of resulting in substantially no influence in the resultant image.

D: Considerably much soiling and the resultant images were also effected at a practically problematic level.

E: Carrier soiling and image deterioration were both severe.

(6) Line scattering

Line images of 1 mm width and 1 mm interval were reproduced, and the scattering of the images were evaluated according to the following standard.

A: No scattering at all.

B: Some scattering was observed but at a level of practically no problem.

C: Considerable scattering was observed at a practically problematic level.

D: Image deterioration due to scattering of line image was severe.

EXAMPLES 42 to 61

Developers Nos. 2 to 21 prepared in Examples 18 to 37 were respectively evaluated with respect to image forming performances in the same manner as in Example 41.

COMPARATIVE EXAMPLES 21 to 30

Comparative Developers Nos. 1 to 10 prepared in Comparative Examples 11 to 20 were respectively evaluated with respect to image forming performances in the same manner as in Example 41.

The results of image forming performance evaluation of the above-mentioned Examples 41 to 61 and Comparative Examples 21 to 30 are inclusively shown in Tables 5 to 8.

EXAMPLE 62

Developer No. 1 including Cyan Toner No. 1, Developer No. 22 including Magenta Toner, Developer No. 23 including Yellow Toner and Developer No. 24 including Black Toner were charged in Developing units Pa, Pb, Pc and Pd, respectively, in a full-color image forming apparatus shown in FIG. 3, and subjected to a full-color mode image forming test, whereby good full-color images could be obtained with good continuous image forming performance and good environmental stability.

TABLE 5

| | Normal temperature/normal humidity (23° C./65% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 41 | 1.48 | 1.49 | A | A | A | A | A | A | A | A | A | A | −26.8 | −26.5 |
| Ex. 42 | 1.47 | 1.49 | A | A | A | A | B | B | B | B | A | A | −25.4 | −24.3 |
| Ex. 43 | 1.48 | 1.50 | B | A | A | A | B | B | B | B | A | A | −24.8 | −23.6 |
| Ex. 44 | 1.47 | 1.47 | A | A | B | B | A | A | B | B | B | A | −28.3 | −29.6 |
| Ex. 45 | 1.48 | 1.46 | B | B | B | B | A | A | B | B | B | B | −29.6 | −30.3 |
| Ex. 46 | 1.46 | 1.46 | B | B | B | B | A | A | B | B | B | B | −30.1 | −31.2 |
| Ex. 47 | 1.47 | 1.48 | A | A | A | A | A | A | A | A | A | A | −27.1 | −30.5 |
| Ex. 48 | 1.48 | 1.49 | A | A | A | A | A | A | A | A | A | A | −24.9 | −26.3 |
| Ex. 49 | 1.48 | 1.48 | A | A | A | A | A | B | A | A | A | A | −24.1 | −24.8 |
| Ex. 50 | 1.47 | 1.48 | A | A | B | B | A | A | A | B | A | B | −23.4 | −24.3 |
| Ex. 51 | 1.47 | 1.46 | A | A | A | A | A | A | B | B | A | B | −27.9 | −29.2 |
| Ex. 52 | 1.48 | 1.52 | A | A | A | B | A | A | A | B | A | B | −27.3 | −22.6 |
| Ex. 53 | 1.49 | 1.53 | A | A | A | B | A | A | A | B | A | B | −29.3 | −29.8 |
| Ex. 54 | 1.48 | 1.52 | A | A | A | B | A | B | A | B | A | B | −22.2 | −24.2 |
| Ex. 55 | 1.48 | 1.51 | A | B | A | B | A | B | A | B | A | B | −23.0 | −24.1 |
| Ex. 56 | 1.49 | 1.49 | A | A | A | A | A | A | A | A | A | A | −25.2 | −25.9 |
| Ex. 57 | 1.42 | 1.44 | A | A | B | B | B | B | B | B | A | A | −29.3 | −31.3 |
| Ex. 58 | 1.51 | 1.51 | A | A | A | A | A | A | B | B | B | B | −21.2 | −22.2 |
| Ex. 59 | 1.52 | 1.51 | A | A | B | B | B | B | B | B | B | B | −20.6 | −19.7 |

TABLE 5-continued

| | Normal temperature/normal humidity (23° C./65% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 60 | 1.49 | 1.49 | A | A | A | A | A | B | A | A | A | A | −25.8 | −24.7 |
| Ex. 61 | 1.48 | 1.52 | A | A | A | A | A | B | A | A | A | A | −29.6 | −27.6 |
| Comp. Ex. 21 | 1.40 | 1.35 | A | A | B | A | B | D | A | D | B | C | −14.2 | −11.4 |
| Comp. Ex. 22 | 1.13 | 1.02 | A | A | B | C | B | D | A | C | C | D | −11.2 | −9.4 |
| Comp. Ex. 23 | 1.25 | 1.28 | A | A | B | C | B | C | A | C | C | D | −20.3 | −16.8 |
| Comp. Ex. 24 | 1.48 | 1.39 | A | A | B | B | B | C | C | D | B | C | −27.1 | −25.6 |
| Comp. Ex. 25 | 1.48 | 1.47 | A | A | B | C | A | A | C | D | B | C | −30.4 | −28.1 |
| Comp. Ex. 26 | 1.48 | 1.31 | B | A | A | C | A | B | A | C | A | B | −24.1 | −19.8 |
| Comp. Ex. 27 | 1.49 | 1.30 | B | A | B | C | A | B | A | D | A | B | −24.9 | −18.6 |
| Comp. Ex. 28 | 1.51 | 1.52 | C | C | A | A | C | C | A | A | A | A | −23.2 | −22.6 |
| Comp. Ex. 29 | 1.40 | 1.39 | A | A | C | D | A | A | C | D | B | C | −29.1 | −30.8 |
| Comp. Ex. 30 | 1.40 | 1.39 | A | A | A | B | B | C | A | A | A | A | −12.5 | −11.8 |

TABLE 6

| | Normal temperature/normal humidity (23° C./10% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 41 | 1.49 | 1.48 | A | A | A | A | A | A | A | A | A | A | −32.5 | −31.7 |
| Ex. 42 | 1.48 | 1.49 | A | A | A | B | A | A | A | B | A | A | −31.0 | −30.6 |
| Ex. 43 | 1.47 | 1.48 | B | A | B | B | A | A | A | B | A | A | −30.6 | −30.1 |
| Ex. 44 | 1.46 | 1.45 | A | A | B | C | A | A | A | B | A | A | −33.7 | −34.1 |
| Ex. 45 | 1.44 | 1.41 | B | B | C | D | A | A | B | C | B | A | −34.8 | −35.6 |
| Ex. 46 | 1.38 | 1.35 | B | B | D | D | A | A | B | C | B | A | −35.9 | −37.1 |
| Ex. 47 | 1.46 | 1.48 | A | A | A | A | A | A | A | A | A | A | −29.2 | −30.1 |
| Ex. 48 | 1.47 | 1.48 | A | A | A | A | A | A | A | A | A | A | −27.1 | −28.9 |
| Ex. 49 | 1.47 | 1.48 | A | A | A | A | A | A | A | A | A | A | −26.5 | −27.2 |
| Ex. 50 | 1.47 | 1.48 | A | A | B | B | A | A | B | B | A | B | −30.1 | −32.1 |
| Ex. 51 | 1.48 | 1.48 | A | A | B | C | A | A | B | C | A | B | −30.5 | −31.6 |
| Ex. 52 | 1.47 | 1.46 | A | A | B | C | A | A | A | C | A | B | −32.5 | −34.3 |
| Ex. 53 | 1.47 | 1.51 | A | A | B | C | A | A | A | B | A | B | −34.1 | −36.2 |
| Ex. 54 | 1.47 | 1.49 | A | A | B | C | A | A | A | B | A | B | −27.1 | −29.1 |
| Ex. 55 | 1.48 | 1.49 | A | B | B | C | A | A | A | B | A | B | −28.3 | −28.9 |
| Ex. 56 | 1.48 | 1.48 | A | A | A | A | A | A | A | A | A | A | −30.1 | −31.6 |
| Ex. 57 | 1.35 | 1.36 | A | A | C | C | A | A | A | A | B | B | −37.6 | −39.1 |
| Ex. 58 | 1.51 | 1.51 | A | A | A | A | A | A | A | A | C | C | −23.2 | −21.6 |
| Ex. 59 | 1.50 | 1.50 | A | A | B | A | A | B | A | A | B | B | −25.6 | −25.7 |
| Ex. 60 | 1.51 | 1.50 | A | A | A | A | A | B | A | A | A | B | −30.3 | −31.6 |
| Ex. 61 | 1.50 | 1.49 | A | A | B | C | A | A | A | A | A | A | −36.7 | −37.1 |
| Comp. Ex. 21 | 1.45 | 1.47 | A | A | B | B | A | C | A | E | B | C | −24.1 | −20.5 |
| Comp. Ex. 22 | 1.26 | 1.22 | A | A | B | B | A | C | A | C | C | D | −18.5 | −17.4 |
| Comp. Ex. 23 | 1.37 | 1.38 | A | A | B | B | A | B | A | C | C | D | −23.1 | −19.3 |
| Comp. Ex. 24 | 1.49 | 1.51 | A | A | B | B | A | B | C | E | B | C | −34.1 | −36.5 |
| Comp. Ex. 25 | 1.51 | 1.50 | A | A | B | C | A | A | C | E | B | C | −37.1 | −38.9 |
| Comp. Ex. 26 | 1.49 | 1.38 | B | A | A | C | A | B | B | D | A | B | −31.6 | −34.5 |
| Comp. Ex. 27 | 1.49 | 1.37 | B | A | B | C | A | B | B | D | A | B | −30.4 | −34.9 |
| Comp. Ex. 28 | 1.51 | 1.51 | D | D | A | A | B | B | A | B | A | A | −27.2 | −26.3 |
| Comp. Ex. 29 | 1.30 | 1.07 | A | A | D | E | A | A | D | E | B | C | −33.1 | −34.5 |
| Comp. Ex. 30 | 1.45 | 1.47 | A | A | A | A | A | B | A | A | A | A | −23.5 | −24.6 |

TABLE 7

| | Low temperature/low humidity (15° C./10% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 41 | 1.50 | 1.49 | A | A | A | A | A | A | A | A | A | A | −31.4 | −30.6 |
| Ex. 42 | 1.49 | 1.50 | A | A | A | B | A | A | A | A | A | A | −30.3 | −30.3 |
| Ex. 43 | 1.48 | 1.49 | B | A | B | B | A | A | A | A | A | A | −30.1 | −29.9 |
| Ex. 44 | 1.46 | 1.46 | A | A | B | C | A | A | A | A | A | A | −33.2 | −33.2 |

TABLE 7-continued

| | Low temperature/low humidity (15° C./10% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 45 | 1.45 | 1.43 | B | B | C | D | A | A | B | C | B | A | −33.7 | −34.1 |
| Ex. 46 | 1.39 | 1.40 | B | B | D | D | A | A | B | C | B | A | −34.8 | −36.5 |
| Ex. 47 | 1.46 | 1.49 | A | A | A | A | A | A | A | A | A | A | −28.1 | −29.1 |
| Ex. 48 | 1.46 | 1.50 | A | A | A | A | A | A | A | A | A | A | −26.5 | −27.8 |
| Ex. 49 | 1.45 | 1.50 | A | A | A | A | A | A | A | A | A | A | −25.4 | −26.8 |
| Ex. 50 | 1.46 | 1.51 | A | A | B | B | A | A | B | B | A | B | −29.4 | −30.1 |
| Ex. 51 | 1.49 | 1.49 | A | A | B | C | A | A | B | C | A | B | −30.3 | −30.5 |
| Ex. 52 | 1.48 | 1.47 | A | A | B | C | A | A | A | C | A | B | −31.8 | −33.1 |
| Ex. 53 | 1.48 | 1.51 | A | A | B | C | A | A | A | B | A | B | −33.8 | −34.9 |
| Ex. 54 | 1.48 | 1.49 | A | A | B | C | A | A | A | B | A | B | −26.5 | −28.1 |
| Ex. 55 | 1.49 | 1.49 | A | B | B | C | A | A | A | B | A | B | −27.3 | −27.8 |
| Ex. 56 | 1.49 | 1.48 | A | A | A | A | A | A | A | A | A | A | −29.6 | −30.6 |
| Ex. 57 | 1.37 | 1.37 | A | A | B | C | A | A | A | A | B | B | −36.7 | −38.1 |
| Ex. 58 | 1.50 | 1.50 | A | A | A | A | A | A | A | A | C | C | −21.1 | −20.6 |
| Ex. 59 | 1.50 | 1.50 | A | A | B | A | A | B | A | A | B | B | −24.8 | −24.7 |
| Ex. 60 | 1.51 | 1.49 | A | A | A | A | A | B | A | A | A | B | −29.2 | −30.8 |
| Ex. 61 | 1.51 | 1.49 | A | A | B | C | A | A | A | A | A | A | −34.9 | −36.5 |
| Comp. Ex. 21 | 1.44 | 1.48 | A | A | B | B | A | C | A | E | B | C | −24.0 | −20.8 |
| Comp. Ex. 22 | 1.27 | 1.24 | A | A | B | B | A | C | A | C | C | D | −18.7 | −17.6 |
| Comp. Ex. 23 | 1.38 | 1.35 | A | A | B | B | A | B | A | C | C | D | −23.7 | −19.6 |
| Comp. Ex. 24 | 1.48 | 1.51 | A | A | B | B | A | B | C | E | B | C | −84.3 | −36.7 |
| Comp. Ex. 25 | 1.50 | 1.51 | A | A | B | C | A | A | C | E | B | C | −37.6 | −38.7 |
| Comp. Ex. 26 | 1.40 | 1.39 | B | A | A | C | A | B | B | D | A | B | −31.8 | −34.6 |
| Comp. Ex. 27 | 1.48 | 1.38 | B | A | B | C | A | B | B | D | A | B | −30.6 | −34.7 |
| Comp. Ex. 28 | 1.50 | 1.50 | D | D | A | A | B | B | A | B | A | A | −27.1 | −26.8 |
| Comp. Ex. 29 | 1.32 | 1.08 | A | A | B | E | A | A | D | E | B | C | −33.3 | −34.2 |
| Comp. Ex. 30 | 1.46 | 1.48 | A | A | A | A | A | B | A | A | A | A | −23.9 | −24.8 |

TABLE 8

| | High temperature/high humidity (32.5° C./85% RH) | | | | | | | | | | | | | |
|---|---|---|---|---|---|---|---|---|---|---|---|---|---|---|
| | Image density | | Carrier attachment | | Fog | | Toner scattering | | Carrier soiling | | Line scattering | | Charge on sleeve (mC/kg) | |
| | initial | final | initial | final | initial | final | initial | final | initial | final | initial | final | initial | final |
| Ex. 41 | 1.47 | 1.49 | A | A | A | A | A | A | A | A | A | A | −22.7 | −24.5 |
| Ex. 42 | 1.48 | 1.46 | A | A | A | B | A | B | A | A | A | A | −21.6 | −23.6 |
| Ex. 43 | 1.49 | 1.45 | B | A | A | A | A | B | A | A | A | A | −20.5 | −23.5 |
| Ex. 44 | 1.49 | 1.50 | A | A | A | A | A | A | A | A | A | A | −23.8 | −26.2 |
| Ex. 45 | 1.50 | 1.51 | B | B | A | A | A | A | B | C | B | A | −24.5 | −27.1 |
| Ex. 46 | 1.49 | 1.50 | B | B | C | C | A | A | B | C | B | A | −20.3 | −23.4 |
| Ex. 47 | 1.47 | 1.48 | A | A | A | A | A | A | A | A | A | A | −19.6 | −22.1 |
| Ex. 48 | 1.48 | 1.49 | A | A | A | A | A | A | A | A | A | A | −18.7 | −21.7 |
| Ex. 49 | 1.48 | 1.47 | A | A | A | A | A | A | A | A | A | A | −19.2 | −22.6 |
| Ex. 50 | 1.48 | 1.49 | A | A | B | B | A | A | B | C | A | B | −21.4 | −24.1 |
| Ex. 51 | 1.48 | 1.46 | A | A | B | B | A | A | B | C | A | B | −21.1 | −23.9 |
| Ex. 52 | 1.47 | 1.51 | A | A | B | B | A | A | A | C | A | B | −22.8 | −25.7 |
| Ex. 53 | 1.46 | 1.49 | A | A | B | B | A | A | A | B | A | B | −23.6 | −26.7 |
| Ex. 54 | 1.47 | 1.49 | A | A | B | B | A | A | A | B | A | B | −20.5 | −24.1 |
| Ex. 55 | 1.48 | 1.47 | A | B | B | B | A | A | A | B | A | B | −20.4 | −23.9 |
| Ex. 56 | 1.47 | 1.48 | A | A | A | A | A | A | A | A | A | A | −21.2 | −24.6 |
| Ex. 57 | 1.47 | 1.48 | A | A | B | B | B | C | A | A | B | B | −23.1 | −26.4 |
| Ex. 58 | 1.49 | 1.49 | A | A | A | A | A | A | A | A | C | C | −17.9 | −20.7 |
| Ex. 59 | 1.48 | 1.38 | A | A | B | A | B | C | A | A | B | B | −20.7 | −23.1 |
| Ex. 60 | 1.42 | 1.31 | A | A | A | A | B | C | A | A | A | B | −21.2 | −24.2 |
| Ex. 61 | 1.49 | 1.48 | A | A | B | B | A | A | A | A | A | A | −24.6 | −26.7 |
| Comp. Ex. 21 | 1.29 | 1.10 | A | A | B | C | B | D | A | D | B | C | −7.5 | −12.6 |
| Comp. Ex. 22 | 1.07 | 1.13 | A | A | B | C | B | D | A | C | C | D | −4.6 | −7.9 |
| Comp. Ex. 23 | 1.29 | 1.37 | A | A | B | C | B | C | A | C | C | D | −16.1 | −15.2 |
| Comp. Ex. 24 | 1.32 | 1.34 | A | A | B | B | B | C | C | D | B | C | −19.2 | −30.2 |
| Comp. Ex. 25 | 1.49 | 1.47 | A | A | B | C | A | A | C | D | B | C | −20.3 | −27.8 |
| Comp. Ex. 26 | 1.48 | 1.50 | B | A | A | C | A | B | A | C | A | B | −18.6 | −21.9 |
| Comp. Ex. 27 | 1.47 | 1.46 | B | A | B | C | A | B | A | D | A | B | −20.1 | −24.8 |
| Comp. Ex. 28 | 1.48 | 1.49 | C | C | A | A | C | C | A | A | A | A | −14.7 | −15.1 |
| Comp. Ex. 29 | 1.39 | 1.41 | A | A | C | D | A | A | C | D | B | C | −22.8 | −21.9 |
| Comp. Ex. 30 | 1.45 | 1.41 | A | A | A | B | B | C | A | A | A | A | −9.2 | −11.1 |

What is claimed is:

1. A magnetic carrier, comprising: a carrier core comprising a first resin and magnetic fine particles dispersed in the first resin, and a second resin surface-coating the carrier core; wherein (a) the magnetic carrier has a true specific gravity of 2.5–4.5, a magnetization $\sigma_{1000}$ as measured in a magnetic field of $1000\times(10^3/4\pi)\cdot$A/m (1000 oersted) of 15–60 $Am^2/kg$ (emu/g), a residual magnetization $\sigma_r$ of 0.1–20 $Am^2/kg$ (emu/g) and a resistivity of $5\times10^{11}$–$5\times10^{15}$ ohm.cm;

(b) the first resin has a polymer chain including a methylene unit (—$CH_2$—);

(c) the second resin has at least a fluoroalkyl unit, a methylene unit (—$CH_2$—) and an ester unit; and (d) the carrier core is surface-coated with (i) a mixture of the second resin and a coupling agent having at least an amino group and a methylene unit, or (ii) a coupling agent having at least an amino group and a methylene unit, and then with the second resin.

2. The magnetic carrier according to claim 1, wherein the carrier core has a true specific gravity of 2.5–4.5.

3. The magnetic carrier according to claim 1, wherein the carrier core contains non-magnetic inorganic compound fine particles in addition to the magnetic fine particles.

4. The magnetic carrier according to claim 3, wherein the magnetic fine particles and the non-magnetic inorganic compound fine particles are contained in a total amount of 70–99 wt. % based on the magnetic carrier.

5. The magnetic carrier according to claim 3, wherein the magnetic fine particles and the non-magnetic inorganic compound fine particles are contained in a total amount of 80–99 wt. % based on the magnetic carrier.

6. The magnetic carrier according to claim 3, wherein the non-magnetic inorganic compound fine particles have a higher resistivity and a larger number-average particle size than the magnetic fine particles.

7. The magnetic carrier according to claim 3, wherein the magnetic fine particles are contained in 30–95 wt. % based on the total of the magnetic fine particles and the non-magnetic inorganic compound fine particles.

8. The magnetic carrier according to claim 3, wherein the magnetic fine particles comprise magnetic iron oxide fine particles.

9. The magnetic carrier according to claim 3, wherein the non-magnetic inorganic compound fine particles comprise non-magnetic iron oxide fine particles.

10. The magnetic carrier according to claim 3, wherein the magnetic fine particles comprise magnetic ferrite fine particles containing at least iron and magnesium.

11. The magnetic carrier according to claim 3, wherein the magnetic fine particles comprise magnetite fine particles.

12. The magnetic carrier according to claim 3, wherein the non-magnetic inorganic compound fine particles comprise fine particles of hematite ($\alpha$-$Fe_2O_3$).

13. The magnetic carrier according to claim 3, wherein the magnetic fine particles have a number-average particle size ($r_a$) of 0.02–2 $\mu$m, and the non-magnetic inorganic compound fine particles have a number-average particle size ($r_b$) of 0.05–5 $\mu$m, satisfying $r_b \geqq 1.5\ r_a$.

14. The magnetic carrier according to claim 3, wherein the carrier core comprises the magnetic fine particles and non-magnetic inorganic compound fine particles dispersed in the first resin, the magnetic fine particles and the non-magnetic inorganic compound fine particles are contained in a total amount of 70–99 wt. % based on the magnetic carrier, the non-magnetic inorganic compound fine particles have a higher resistivity and a larger number-average particle size than the magnetic fine particles, the magnetic carrier has a number-average particle size of 15–60 $\mu$m, the magnetic fine particles have a number-average particle size ($r_a$) of 0.02–2 $\mu$m, and the non-magnetic inorganic compound fine particles have a number-average particle size ($r_b$) of 0.05–5 $\mu$m, satisfying $r_b \geqq 1.5\ r_a$, and the carrier core is coated with 0.01–5 wt. % (based on the magnetic carrier) of the second resin and 0.01–5 wt. % (based on the magnetic carrier) of the coupling agent.

15. The magnetic carrier according to claim 14, wherein the carrier core is surface-coated with a mixture of the second resin and the coupling agent.

16. The magnetic carrier according to claim 14, wherein the carrier core is first coated with the coupling agent and then with the second resin.

17. The magnetic carrier according to claim 1, wherein the magnetic carrier has a number-average particle size of 15–60 $\mu$m, and the magnetic fine particles have a number-average particle size ($r_a$) of 0.02–2 $\mu$m.

18. The magnetic carrier according to claim 1, wherein the magnetic carrier has a true specific gravity of 3.0–4.3.

19. The magnetic carrier according to claim 1, wherein the magnetic carrier has a residual magnetization ($\sigma_r$) of 0.3–10 $Am^2/kg$ (emu/g).

20. The magnetic carrier according to claim 1, wherein the magnetic carrier has a shape factor SF-1 of 100–130.

21. The magnetic carrier according to claim 1, wherein the first resin is a resin having a methylene unit selected from the group consisting of vinyl resin, polyester resin, epoxy resin, phenolic resin, urea resin, polyurethane resin, polyimide resin, cellulose resin, and polyether resin.

22. The magnetic carrier according to claim 1, wherein the first resin comprises a thermosetting resin.

23. The magnetic carrier according to claim 1, wherein the first resin comprises a thermoplastic resin having a methylene unit.

24. The magnetic carrier according to claim 1, wherein the first resin comprises a phenolic resin having a methylene unit.

25. The magnetic carrier according to claim 1, wherein the second resin has a perfluoroalkyl unit represented by $$CF_3\text{-}(CF_2)_m,$$

wherein m is an integer of 0–20.

26. The magnetic carrier according to claim 1, wherein the second resin has a unit represented by $$CF_3\text{—}(CF_2)_m\text{—}(CH_2)_n,$$

wherein m is an integer of 0–20 and n is an integer of 1–15.

27. The magnetic carrier according to claim 1, wherein the second resin has a unit represented by $$CF_3\text{—}(CF_2)_m\text{—}(CH_2)_n\text{—}O\text{—}\underset{\underset{O}{\|}}{C}\text{—},$$

wherein m is an integer of 0–20, and n is an integer of 1–15.

28. The magnetic carrier according to claim 27, wherein the coupling agent is a silane coupling agent or a titanate coupling agent.

29. The magnetic carrier according to claim 27, wherein the coupling agent is an aminoalkylalkoxysilane selected from the group consisting of γ-aminopropyltrialkoxysilane, N-β-(aminoethyl)-γ-aminopropyltrialkoxysilane, N-β-(aminoethyl)-γ-aminopropylmethyldialkoxysilane, and N-phenyl-γ-amino-propyltrialkoxysilane.

30. The magnetic carrier according to claim 27, wherein the carrier is coated with 0.01–5 wt. % (based on the magnetic carrier) of the second resin and 0.01–5 wt. % (based on the magnetic carrier) of the coupling agent.

31. The magnetic carrier according to claim 27, wherein the first resin forming the carrier core has a hydroxyl or/and phenol group, with which a residue group of the coupling agent is connected to the carrier core surface.

32. The magnetic carrier according to claim 1, wherein the second resin has a unit represented by

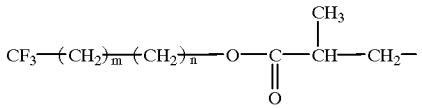

wherein m is an integer of 0–20 and n is an integer of 1–15.

33. The magnetic carrier according to claim 1, wherein the second resin has a unit represented by

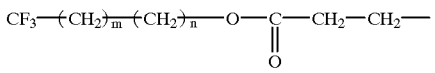

wherein m is an integer of 0–20 and n is an integer of 1–15.

34. The magnetic carrier according to claim 1, wherein the second resin is a polymer or copolymer having a fluoroalkyl unit of methacrylic acid or an ester thereof.

35. The magnetic carrier according to claim 1, wherein the second resin is a polymer or copolymer having a fluoroalkyl unit of acrylic acid or an ester thereof.

36. The magnetic carrier according to claim 1, wherein the second resin is a graft copolymer having a fluoroalkyl unit.

37. The magnetic carrier according to claim 1, wherein the second resin is a graft copolymer having a unit of

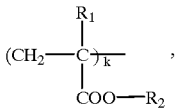

wherein $R_1$ denotes hydrogen or methyl, $R_2$ denotes hydrogen or alkyl having 1–20 carbon atoms and k is an integer of at least 1, and also a unit of

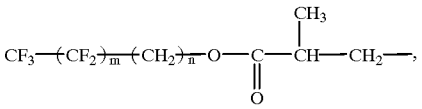

wherein m is an integer of 0–20, and n is an integer of 1–15.

38. The magnetic carrier according to claim 1, wherein the second resin has a weight-average molecular weight of $2\times10^4$–$3\times10^5$ as measured according to gel permeation chromatography (GPC) of its tetrahydrofuran (THF)-soluble content.

39. The magnetic carrier according to claim 1, wherein the second resin contains a THF-soluble content providing a GPC chromatogram exhibiting a main peak in a molecular weight region of $2\times10^3$ to $10^5$.

40. The magnetic carrier according to claim 1, wherein the second resin contains a THF-soluble content providing a GPC chromatogram exhibiting a sub-peak or shoulder in a molecular weight region of $2\times10^3$ to $10^5$.

41. The magnetic carrier according to claim 1, wherein the second resin contains a THF-soluble content providing a GPC chromatogram exhibiting a main peak in a molecular weight region of $2\times10^4$ to $10^5$, and a sub-peak or shoulder in a molecular weight region of $2\times10^3$ to $1.9\times10^4$.

42. The magnetic carrier according to claim 1, wherein the coupling agent is a silane coupling agent or a titanate coupling agent.

43. The magnetic carrier according to claim 1, wherein the coupling agent is an aminoalkylalkoxysilane selected from the group consisting of γ-aminopropyltrialkoxysilane, N-β-(aminoethyl)-γ-aminopropyltrialkoxysilane, N-β-(aminoethyl)-γ-aminopropylmethyldialkoxysilane, and N-phenyl-γ-amino-propyltrialkoxysilane.

44. The magnetic carrier according to claim 1, wherein the carrier is coated with 0.01–5 wt. % (based on the magnetic carrier) of the second resin and 0.01–5 wt. % (based on the magnetic carrier) of the coupling agent.

45. The magnetic carrier according to claim 1, wherein the first resin forming the carrier core has a hydroxyl or/and phenol group, with which a residue group of the coupling agent is connected to the carrier core surface.

46. The magnetic carrier according to claim 1, wherein the magnetic fine particles have a resistivity A of $1\times10^3$ to $1\times10^{10}$ ohm.cm, and the non-magnetic inorganic compound fine particles have a resistivity B of $1\times10^8$ to $1\times10^{15}$ ohm.cm which is at least 10 times the resistivity A.

47. The magnetic carrier according to claim 1, wherein the carrier core has been obtained by polymerizing a mixture comprising at least a polymerizable monomer for providing the first resin and the magnetic fine particles.

48. The magnetic carrier according to claim 47, wherein the mixture further contains non-magnetic inorganic compound fine particles.

49. The magnetic carrier according to claim 47, wherein the polymerizable monomer comprises a phenol compound and an aldehyde compound.

50. A two-component developer, comprising: a negatively chargeable toner, and a magnetic carrier, wherein the toner comprises toner particles and an external additive, and wherein the magnetic carrier is a magnetic carrier according to any one of claims 2 to 49.

51. The two-component developer, comprising: a negatively chargeable toner, and a magnetic carrier, wherein the toner comprises toner particles and an external additive, the magnetic carrier comprises a carrier core comprising a first resin and magnetic fine particles dispersed in the first resin, and a second resin surface-coating the carrier core; wherein (a) the magnetic carrier has a true specific gravity of 2.5–4.5, a magnetization $\sigma_{1000}$ as measured in a magnetic field of $1000\times(10^3/4\pi)\cdot A/m$ (1000 oersted) of 15–60 $Am^2/kg$ (emu/g), a residual magnetization $\sigma_r$ of 0.1–20 $Am^2/kg$ (emu/g) and a resistivity of $5\times10^{11}$–$5\times10^{15}$ ohm.cm;

(b) the first resin has a polymer chain including a methylene unit (—$CH_2$—);

(c) the second resin has at least a fluoroalkyl unit, a methylene unit (—$CH_2$—) and an ester unit; and (d) the carrier core is surface-coated with (i) a mixture of the second resin and a coupling agent having at least an amino group and a methylene unit, or (ii) a coupling agent having at least an amino group and a methylene unit, and then with the second resin.

52. The developer according to claim 51, wherein the negatively chargeable toner has a weight-average particle size of 3.0–9.9 μm.

53. The developer according to claim 51, wherein the negatively chargeable toner contains a metal compound of aromatic hydroxycarboxylic acid.

54. The developer according to claim 51, wherein the external additive has a number-average particle size of 3–100 nm.

55. The developer according to claim 51, wherein the external additive has a BET specific surface area of 30–400 $m^2/g$.

56. The developer according to claim 51, wherein the external additive comprises fine powder of metal oxide or metal oxide complex.

57. The developer according to claim 51, wherein the external additive comprises hydrophobic fine powder of silica, titanium oxide or alumina.

58. The developer according to claim 51, wherein the toner is a non-magnetic toner, has a weight-average particle size of 3.0–9.9 μm and contains a metal compound of aromatic hydroxycarboxylic acid; and the external additive has a number-average particle size of 3–100 nm and comprises a hydrophobic inorganic fine powder selected from the group consisting of hydrophobic fine powders of silica, titanium oxide and alumina.

59. The developer according to claim 51, wherein the negatively chargeable toner has a shape factor SF-1 of 100–140, and the external additive comprises at least hydrophobic silica fine powder.

60. The developer according to claim 51, wherein the negatively chargeable toner has a shape factor SF-1 of 100–130.

61. The developer according to claim 51, wherein the toner particles comprise a binder resin and a solid wax in 1–40 wt. parts per 100 wt. parts of the binder resin.

62. The developer according to claim 51, wherein the negatively chargeable toner contains 0.5–5.0 wt. parts of the external additive per 100 wt. parts of the toner particles.

63. The developer according to claim 51, wherein the negatively chargeable toner shows a triboelectric chargeability of −15 to −40 mC/kg with respect to the magnetic carrier.

64. The developer according to claim 51, wherein the toner particles comprises particles directly formed by polymerization, and the carrier core comprises particles directly formed by polymerization.

65. An image forming method, comprising: charging an electrostatic image-bearing member, exposing the charged electrostatic image-bearing member to light image to form an electrostatic image on the electrostatic image-bearing member, developing the electrostatic image by a developing means including a two-component developer to form a toner image on the electrostatic image-bearing member, transferring the toner image on the electrostatic image-bearing member via or without via an intermediate transfer member onto a transfer material, and fixing the toner image on the transfer material under application of heat and pressure to form a fixed toner image on the transfer material, wherein the two-component developer comprises a negatively chargeable toner, and a magnetic carrier, the toner comprises toner particles and an external additive, the magnetic carrier comprises a carrier core comprising a first resin and magnetic fine particles dispersed in the first resin, and a second resin surface-coating the carrier core; wherein (a) the magnetic carrier has a true specific gravity of 2.5–4.5, a magnetization $\sigma_{1000}$ as measured in a magnetic field of $1000\times(10^3/4\pi)\cdot A/m$ (1000 oersted) of 15–60 $Am^2/kg$ (emu/g), a residual magnetization $\sigma_r$ of 0.1–20 $Am^2/kg$ (emu/g) and a resistivity of $5\times10^{11}$–$5\times10^{15}$ ohm.cm;

(b) the first resin has a polymer chain including a methylene unit (—$CH_2$—);

(c) the second resin has at least a fluoroalkyl unit, a methylene unit (—$CH_2$—) and an ester unit; and (d) the carrier core is surface-coated with (i) a mixture of the second resin and a coupling agent having at least an amino group and a methylene unit, or (ii) a coupling agent having at least an amino group and a methylene unit, and then with the second resin.

66. The image forming method according to claim 65, wherein the developing means includes a developing sleeve enclosing therein a magnetic field-generating means, and the electrostatic image is developed by the two-component developer while applying a bias voltage of an alternating form, a pulse form or a blanked pulse form.

67. The image forming method according to claim 65, wherein the electrostatic image is digital latent image and is developed according to a reversal development mode.

68. The image forming method according to claim 65, wherein the developing means includes a developing sleeve and a fixed magnet as a magnetic field generating means enclosed within the developing sleeve, and the electrostatic image is developed with the two-component developer at a magnetic field strength at the developing sleeve surface in a developing region of $500–1000\times(10^3/4\pi)A\cdot m$ (=500–1000 oersted).

* * * * *

UNITED STATES PATENT AND TRADEMARK OFFICE

CERTIFICATE OF CORRECTION

PATENT NO. : 6,124,067
DATED : September 26, 2000
INVENTOR(S) : Yushi Mikuriyama et al.

It is certified that error appears in the above-identified patent and that said Letters Patent is hereby corrected as shown below:

Column 1,
Line 20, "fixed" should read -- fixed, --; and
Line 21, ", e.g.," should read -- e.g., --.

Column 7,
Line 37, "receives" should read -- receives an --; and
Line 44, "(ra)" should read -- ($r_a$) --.

Column 10,
Line 18, "$3x10^3$ - $10^4$." should read -- $3x10^3$ -$1x10^4$. --.

Column 11,
Line 50, "he" should read -- the --.

Column 13,
Line 20, "adsorb" should read -- to adsorb --; and
Line 29, "surfactant" should read -- surfactants --.

Column 15,
Line 56, "sulfqnic" should read -- sulfonic --.

Column 17,
Line 41, "damage" should read -- damaged --.

Column 19,
Line 2, "be" should read -- be a --; and
Line 19, "blended by a blended," should read -- blended by a blender, --.

Column 23,
Line 40, "as" should read -- a --.

Column 24,
Line 38, "the" should read -- by the --.

Column 30,
Line 64, "device" should read -- device --.

UNITED STATES PATENT AND TRADEMARK OFFICE

CERTIFICATE OF CORRECTION

PATENT NO. : 6,124,067
DATED : September 26, 2000
INVENTOR(S) : Yushi Mikuriyama et al.

It is certified that error appears in the above-identified patent and that said Letters Patent is hereby corrected as shown below:

Column 37,
Line 49, "$-\!\!\left(\!\!\left(\text{OCH}_3\right)_3$," should --$-\!\!\left(\text{OCH}_3\right)_3$,--; read Line 52, "γ-aminopropyl-trimethopysilane" should read -- γ-aminopropyltrimethoxysilane --.

Column 40,
Line 41, "EXAMPLE 8" should read -- EXAMPLE 9 --.

Column 42,
Line 20, "164" should read -- 154 --.

Column 43,
Line 20, "Ex. 15 styrene acrylic resin" should read -- Ex. 15" --.

Column 45,
Line 3, "Hydrophillic" should read -- Hydrophilic --; and
Line 4, "($S_{ET}$= 200" should read -- ($S_{RET}$= 200 --;
Line 5, "Hydrophillic" should read -- Hydrophilic --.

Column 49,
Line 29, "sheet" should read -- sheets --; and
Table 5, "1.48 1.48" should read -- 1.46 1.48 --.

Column 51,
Table 5, "1.49 1.49" should read -- 1.49 1.52 --;
Table 5, "A" should read -- B --;
Table 5, "A" should read -- C --;
Table 5, "1.48" should read -- 1.43 --;

UNITED STATES PATENT AND TRADEMARK OFFICE

CERTIFICATE OF CORRECTION

PATENT NO. : 6,124,067
DATED : September 26, 2000
INVENTOR(S) : Yushi Mikuriyama et al.

It is certified that error appears in the above-identified patent and that said Letters Patent is hereby corrected as shown below:

Column 53,
Table 7, "-84.3" should read -- 34.3 --; and
Table 8, "1.48" should read -- 1.43 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*